US010978787B2

(12) United States Patent
Kim et al.

(10) Patent No.: US 10,978,787 B2
(45) Date of Patent: Apr. 13, 2021

(54) LOW-LOSS AND FLEXIBLE TRANSMISSION LINE-INTEGRATED MULTI-PORT ANTENNA FOR MMWAVE BAND

(71) Applicant: SENSORVIEW INCORPORATED, Gyeonggi-do (KR)

(72) Inventors: Byoung Nam Kim, Gyeonggi-do (KR); Hong Il Yoo, Seoul (KR); Sang Woo Han, Gyeonggi-do (KR)

(73) Assignee: SENSORVIEW INCORPORATED, Gyeonggi-Do (KR)

( * ) Notice: Subject to any disclaimer, the term of this patent is extended or adjusted under 35 U.S.C. 154(b) by 0 days.

(21) Appl. No.: 16/686,505

(22) Filed: Nov. 18, 2019

(65) Prior Publication Data

US 2020/0168980 A1 May 28, 2020

(30) Foreign Application Priority Data

Nov. 26, 2018 (KR) ..... 10-2018-0147643

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 1/48* (2013.01); *H01Q 9/0421* (2013.01);
(Continued)

(58) Field of Classification Search
CPC combination set(s) only.
See application file for complete search history.

(56) References Cited

U.S. PATENT DOCUMENTS 6,958,729 B1 * 10/2005 Metz ..... H01P 3/08 343/700 MS
8,462,063 B2 * 6/2013 Gummalla ..... H01Q 25/00 343/745
(Continued)

FOREIGN PATENT DOCUMENTS

JP 2008-193663 A 8/2008
JP 2017-150054 A 8/2017
JP 2018-074240 A 5/2018

OTHER PUBLICATIONS

Office Action from corresponding Japanese Patent Application No. 2019-213719, dated Dec. 22, 2020.

*Primary Examiner* — Jason Crawford
(74) *Attorney, Agent, or Firm* — Harness, Dickey & Pierce, P.L.C.

(57) ABSTRACT

Disclosed is a low-loss and flexible transmission line-integrated multi-port antenna for an mmWave band. The multi-port antenna includes a plurality of antennas arranged on different substrate layers to form a multi port and a plurality of transmission lines corresponding to the plurality of antennas, respectively, in which central conductors used as signal lines of the transmission lines are integrated with corresponding electricity feeding portions of the antennas and arranged on different layers. Here, the antennas each include a dielectric substrate formed as a dielectric having a certain thickness on a ground plate, and a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal.

10 Claims, 41 Drawing Sheets

(51) Int. Cl.

| | |
|---|---|
| ***H01Q 9/04*** | (2006.01) |
| ***H01Q 9/16*** | (2006.01) |
| ***H01Q 9/30*** | (2006.01) |
| ***H01Q 21/00*** | (2006.01) |
| ***H01Q 1/48*** | (2006.01) |
| ***H01Q 13/10*** | (2006.01) |
| ***H01Q 21/28*** | (2006.01) |

(52) U.S. Cl.
CPC ..... *H01Q 9/16* (2013.01); *H01Q 9/30* (2013.01); *H01Q 13/10* (2013.01); *H01Q 21/0075* (2013.01); *H01Q 21/28* (2013.01)

(56) References Cited

U.S. PATENT DOCUMENTS

| | | | | |
|---|---|---|---|---|
| 2018/0192514 | A1 | 7/2018 | Seo | |
| 2020/0127378 | A1* | 4/2020 | Kim | H01Q 1/243 |
| 2020/0203851 | A1* | 6/2020 | Takaki | H01Q 9/0457 |
| 2020/0251825 | A1* | 8/2020 | Kim | H01Q 9/40 |

* cited by examiner

LOW-LOSS AND FLEXIBLE TRANSMISSION LINE-INTEGRATED MULTI-PORT ANTENNA FOR MMWAVE BAND

CROSS-REFERENCE TO RELATED APPLICATION

This application claims priority to and the benefit of Korean Patent Application No. 10-2018-0147643, filed on Nov. 26, 2018, the disclosure of which is incorporated herein by reference in its entirety.

FIELD

The present invention relates to an antenna for mmWave band, and more particularly, to a low-loss and flexible transmission line-integrated multi-port antenna in which a low-loss nanosheet is used instead of an existing polyimide (PI) or liquid crystal polymer (LCP)-based material, which has a high loss, and a transmission line and an antenna are integrated with each other to be applicable to a mobile device.

BACKGROUND

A next-generation 5G mobile communication system performs communication through a high frequency band of several ten GHzs, and a smart phone needs an antenna for a high frequency band of several ten GHzs therein. Particularly, a mobile built-in antenna used in a mobile device such as a smart phone receives a lot of influence of an internal environment of the smart phone. Here, it is necessary to locate an antenna at a position of minimizing an influence of surroundings. Also, in order to transmit or treat a superhigh frequency at a low loss, a low-loss and high performance transmission line is necessary.

Generally, dielectrics used in an antenna and a transmission line may reduce a loss of transmitted as a loss of permittivity is low. Accordingly, to manufacture a transmission line and an antenna which have a low-loss and high performance for superhigh frequency signal transmission, it is necessary to use a material having low relative permittivity and a low dielectric loss tangent if possible. Particularly, in order to efficiently transmit signals having frequencies within bands of 3.5 GHz and 28 GHz used in 5G mobile communication network, the significance of a transmission line and an antenna which have a low loss even in an mmWave band of 28 GHz more and more increases.

SUMMARY

The present invention is directed to providing a low-loss and flexible transmission line-integrated multi-port antenna for an mmWave band, in which a material having low relative permittivity and a low dielectric loss tangent value is used and a low loss and high performance transmission line and an antenna are integrated using a flexible material having a variety of flexibilities.

The present invention is also directed to providing a mobile communication terminal including the low-loss and flexible transmission-integrated multi-port antenna for an mmWave band.

According to an aspect of the present invention, there is provided a low-loss and flexible transmission line-integrated multi-port antenna for an mmWave band. The low-loss and flexible transmission line-integrated multi-port antenna for an mmWave band includes a plurality of antennas arranged on different substrate layers to form a multi port and a plurality of transmission lines corresponding to the plurality of antennas, respectively, in which central conductors used as signal lines of the transmission lines are integrated with corresponding electricity feeding portions of the antennas and arranged on different layers. Here, the antennas each include a dielectric substrate formed as a dielectric having a certain thickness on a ground plate, a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal, and an electricity feeding portion formed on the dielectric substrate and connected to the signal conversion portion. Here, the transmission lines each include a central conductor having one end integrated with the electricity feeding portion of the antenna and configured to transfer the transmitted or received electrical signal, an external conductor having the same axis as that of the central conductor and configured to shield the central conductor in an axial direction of the central conductor, and a dielectric formed between the central conductor and the external conductor in the axial direction. Also, the dielectric is a low-loss nanosheet material formed as a nanosheet including a lot of air spaces by electrospinning a resin at a high voltage.

In the plurality of transmission lines, the central conductor at one end of each of the transmission lines may be integrated with the corresponding electricity feeding portion of the antenna and the central conductor at the other end of each of the transmission lines may be connected to a signal line of a transmission/reception module of the mobile communication terminal. Here, the central conductors at the other ends of the transmission lines may be vertically arranged on different layers. Also, the central conductors may be horizontally spaced apart from each other on different layers at a position close to the transmission/reception module and be close and integrally connected to the corresponding electricity feeding portions of the antennas while being spaced apart from each other.

In the plurality of transmission lines, the central conductor at one end of each of the transmission lines may be integrated with the corresponding electricity feeding portion of the antenna and the central conductor at the other end of each of the transmission lines may be connected to a signal line of a transmission/reception module of the mobile communication terminal. Here, the central conductors at the other ends of the transmission lines may be vertically arranged on different layers. Also, the plurality of transmission lines may be horizontally spaced apart from each other on different layers for each transmission line at a position close to the transmission/reception module while the central conductors are vertically arranged such that the central conductors may be integrated with the corresponding electricity feeding portions of the antennas.

According to another aspect of the present invention, there is provided a low-loss and flexible transmission line-integrated multi-port antenna for an mmWave band. The low-loss and flexible transmission line-integrated multi-port antenna includes a plurality of antennas horizontally arranged on the same substrate layer to form a multi port and a plurality of transmission lines corresponding to the plurality of antennas, respectively, in which central conductors used as signal lines of the transmission lines are integrated with corresponding electricity feeding portions of the antennas and horizontally arranged on the same layer. Here, the antennas each include a dielectric substrate formed as a dielectric having a certain thickness on a ground plate, a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal, and an electricity feeding portion formed on the dielectric substrate and connected to the signal conversion portion. Here, the transmission lines each include a central conductor having one end integrated with the electricity feeding portion of the antenna and configured to transfer the transmitted or received electrical signal, an external conductor having the same axis as that of the central conductor and configured to shield the central conductor in an axial direction of the central conductor, and a dielectric formed between the central conductor and the external conductor in the axial direction. Also, the dielectric is a low-loss nanosheet material formed as a nanosheet including a lot of air spaces by electrospinning a resin at a high voltage.

In the plurality of transmission lines, the central conductor at one end of each of the transmission lines may be integrated with the corresponding electricity feeding portion of the antenna and the central conductor at the other end of each of the transmission lines is connected to a signal line of a transmission/reception module of the mobile communication terminal. Here, the central conductors at the other ends of the transmission lines may be horizontally arranged on the same layer. Also, the plurality of transmission lines may be close to the electricity feeding portions of the antennas while being horizontally arranged without a gap therebetween and be horizontally spaced apart from each other at a position close to the transmission/reception module such that the central conductors may be integrated with the corresponding electricity feeding portions of the antennas.

In the plurality of transmission lines, the central conductor at one end of each of the transmission lines may be integrated with the corresponding electricity feeding portion of the antenna and the central conductor at the other end of each of the transmission lines may be connected to a signal line of a transmission/reception module of the mobile communication terminal. Here, the central conductors at the other ends of the transmission lines may be horizontally arranged on the same layer. Also, the transmission lines may be horizontally spaced apart from each other at a position close to the transmission/reception module and be close and integrally connected to the corresponding electricity feeding portions of the antennas while being spaced apart from each other.

The antennas and the transmission lines may be formed by reinforcing a bonding force between the conductor and a dielectric sheet using a low-loss bonding sheet or bonding solution or depositing the conductor on a nanosheet.

The transmission lines may each include a nanosheet dielectric having a certain thickness, conductor surfaces formed on a top surface and a bottom surface of the nanosheet dielectric, and a stripline transmission line formed as a signal line in a center of the nanosheet dielectric and the conductor surfaces. Also, a plurality of via holes may be formed between the conductor surface formed above the nanosheet dielectric and the conductor surface formed below the nanosheet dielectric.

According to still another aspect of the present invention, there is provided a mobile communication terminal including the above-described low-loss and flexible transmission line-integrated multi-port antenna.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 36B illustrates a gain property when only one port is turned on;

FIG. 37B illustrates a gain property when all four ports are turned on;

DETAILED DESCRIPTION

Figure 1A:
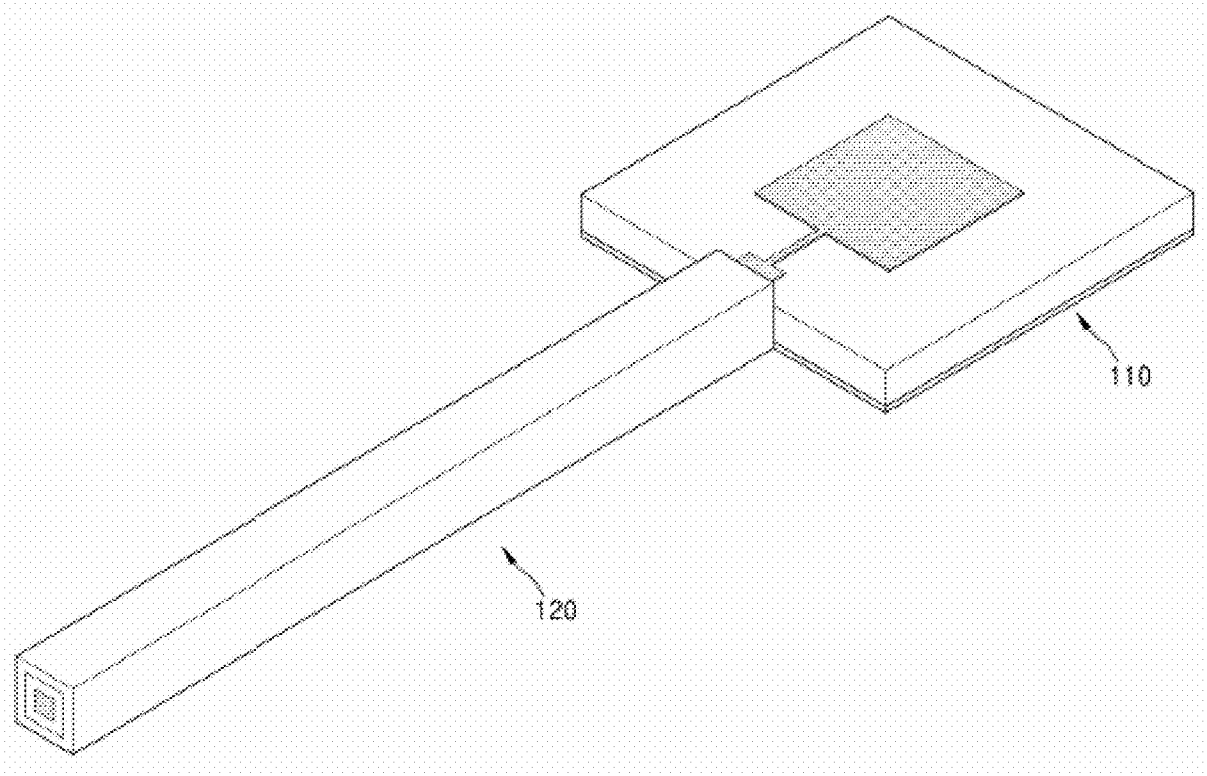
FIG. 1A is a perspective view of a transmission line-integrated patch antenna as an example of an antenna used in a low-loss and flexible transmission line-integrated multi-port antenna for an mmWave band one embodiment of the present invention.

Hereinafter, exemplary embodiments of the present invention will be described in detail with reference to the attached drawings. Since the embodiments disclosed in the specification and components shown in the drawings are merely exemplary embodiments of the present invention and do not represent an entirety of the technical concept of the present invention, it should be understood that a variety of equivalents and modifications capable of substituting the embodiments and the components may be present at the time of filing of the present application.

A low-loss and flexible transmission line-integrated multi port antenna according to an embodiment of the present invention includes low-loss and flexible transmission line-integrated single-port antennas are arranged in a variety of structures, for example, a vertical structure and a horizontal structure.

The low-loss and flexible transmission line-integrated single port antenna used as an element of the low-loss and flexible transmission line-integrated multi-port antenna for an mmWave band according to the present invention will be described first, and then, the low-loss and flexible transmission line-integrated multi-port antenna for an mmWave band according to the present invention will be described.

Figure 1B:
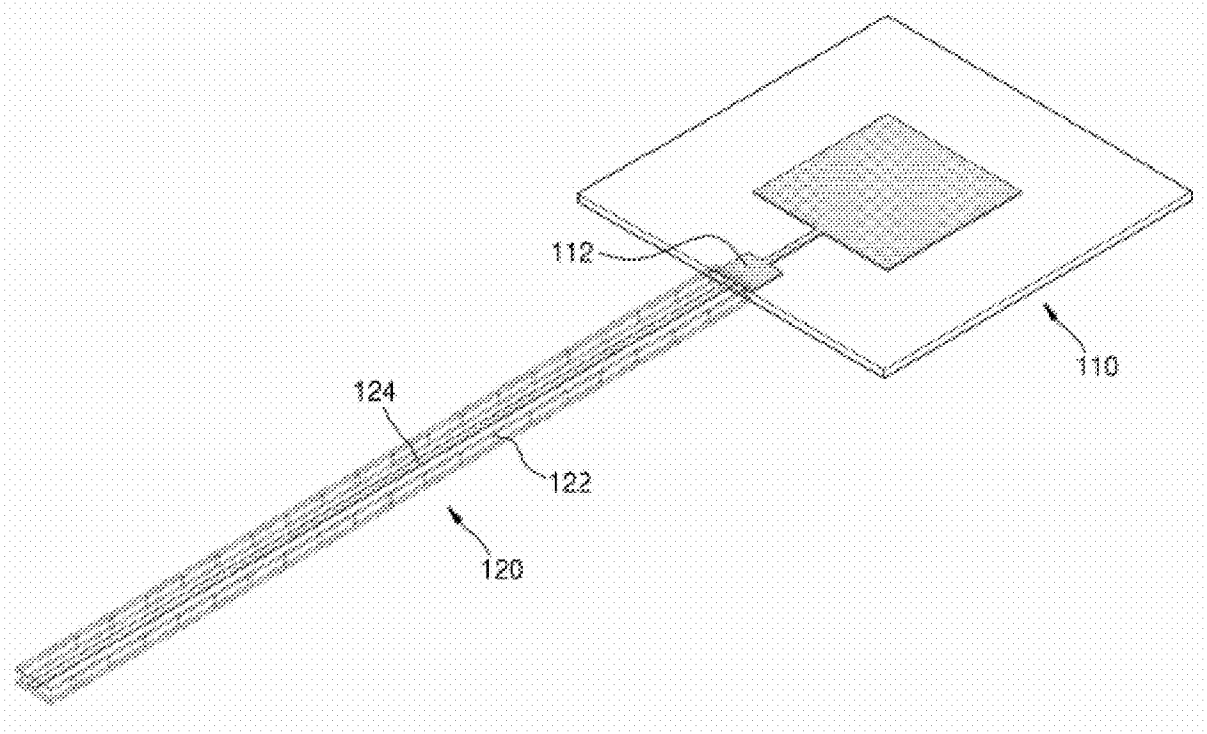
FIG. 1B is a perspective view of a transmission line-integrated antenna utilizing a substrate integrated waveguide (SIW) structure which is applicable to mass production.
Figure 1C:
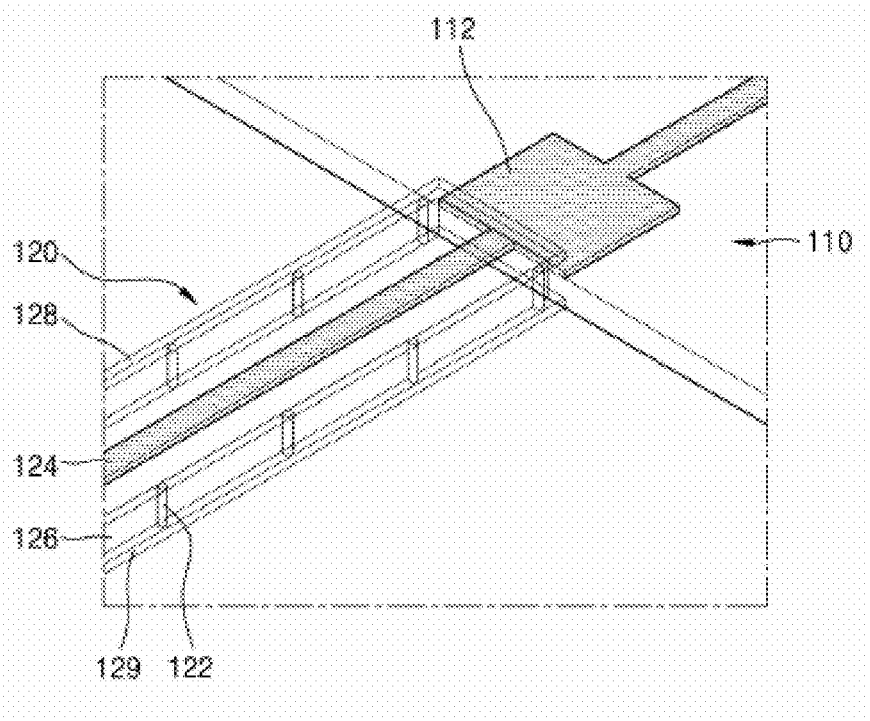
FIG. 1C is an enlarged view of the SIW structure of the transmission line-integrated antenna of FIG. 1B.

FIG. 1A illustrates a transmission line-integrated patch antenna as an example of a low-loss and flexible transmission line-integrated single-port antenna for an mmWave band which is used in one embodiment of the present invention. FIG. 1B illustrates a transmission line-integrated antenna utilizing a substrate integrated waveguide (SIW) structure which is applicable to mass production. FIG. 1C is an enlarged view illustrating the SIW structure of the transmission line-integrated antenna of FIG. 1B.

Figure 2:
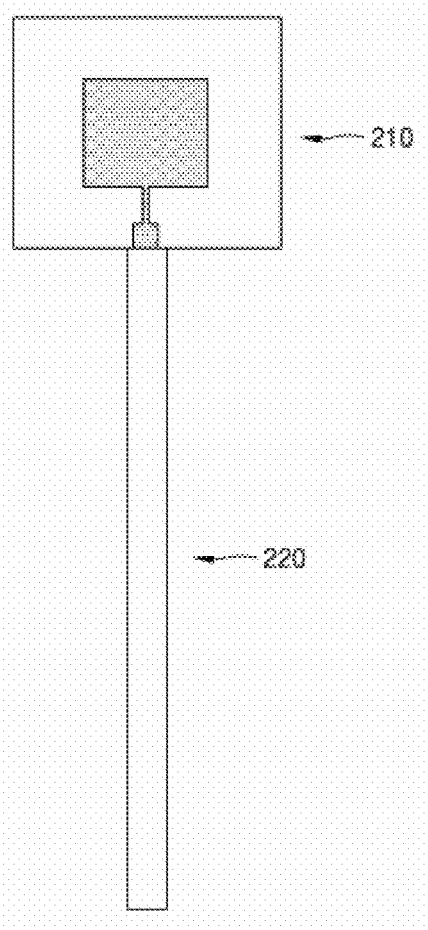
FIG. 2 is a plan view of a low-loss and flexible transmission line-integrated antenna for an mmWave band used as a unit antenna in one embodiment of the present invention.
Figure 3:
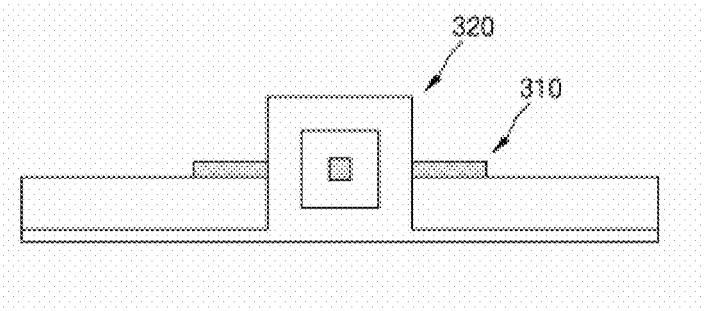
FIG. 3 is a front view of a low-loss and flexible transmission line-integrated antenna for an mmWave band used as a unit antenna in one embodiment of the present invention.

FIG. 2 is a plan view of a transmission line-integrated single-port patch antenna used in one embodiment of the present invention. FIG. 3 is a front view of a transmission line-integrated single-port patch antenna used in one embodiment of the present invention.

Referring to FIGS. 1A to 3, the transmission line-integrated single-port patch antenna used in the embodiments of the present invention includes an antenna 110, 210, or 310 and a transmission line 120, 220, or 320 integrated with the antenna 110, 210, or 310.

Figure 4:
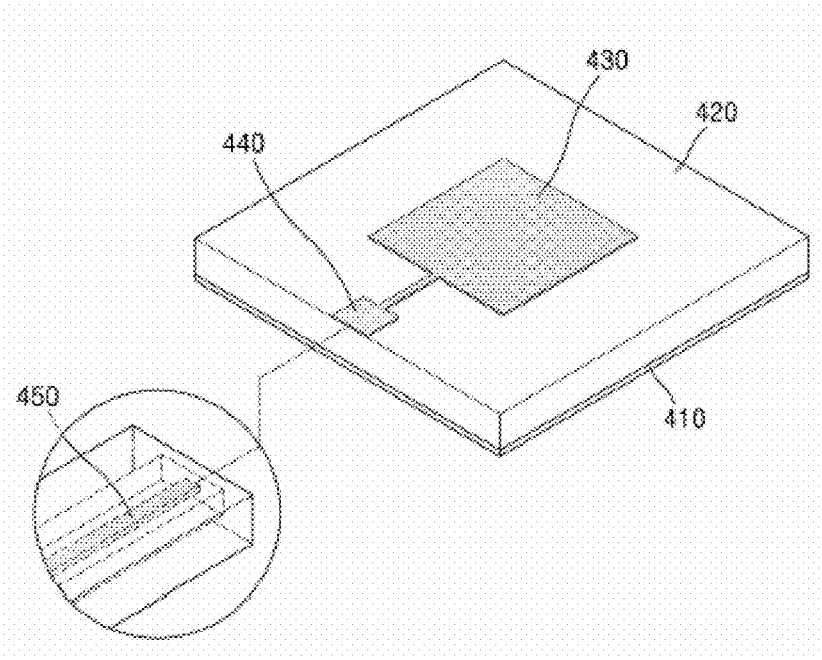
FIG. 4 is a perspective view of a patch antenna used in one embodiment of a low-loss and flexible transmission line-integrated multi-port antenna for an mmWave band according to the present invention.
Figure 5:
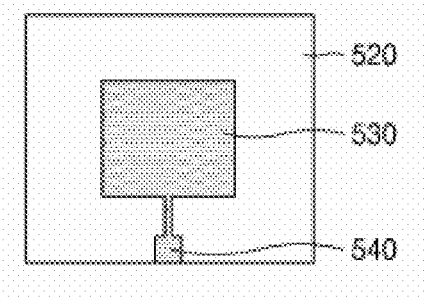
FIG. 5 is a plan view of a patch antenna used in one embodiment of a low-loss and flexible transmission line-integrated antenna for an mmWave band according to the present invention.
Figure 6:
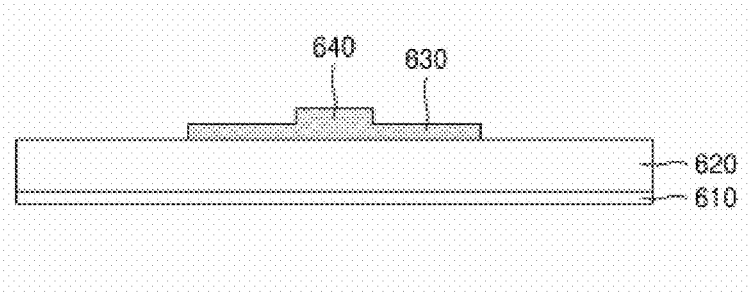
FIG. 6 is a front view of a patch antenna as an example of a low-loss and flexible transmission line-integrated antenna used in a transmission line-integrated multi-port antenna according to the present invention.

FIG. 4 illustrates a patch antenna as an example of the low-loss and flexible transmission line-integrated antenna for an mmWave band which is an element of the present invention. FIG. 5 is a plan view of a patch antenna as an example of the low-loss and flexible transmission line-integrated single-port antenna for an mmWave band which is an element of the present invention. FIG. 6 is a front view of the patch antenna.

Referring to 1A to 6, the patch antenna 110, 210, or 310 includes a ground plate 410 or 610, a dielectric substrate 420, 520, or 620, a signal conversion portion 430, 530, or 630, and an electricity feeding portion 440, 540, or 640.

The ground plate 410 or 610 is located on a bottom surface of the patch antenna 110 or 210, performs a function of a ground, and includes a metal. The dielectric substrate 420, 520, or 620 is formed of a dielectric having a certain thickness on the ground plate 410 or 610.

The signal conversion portion 430, 530, 630 is formed on the dielectric substrate 420, 520, or 620 and converts an electrical signal of a mobile communication device into an electromagnetic wave signal and radiates the electromagnetic wave signal into the air or receives and converts an electromagnetic wave signal in the air into an electrical signal of a mobile communication terminal. The electricity feeding portion 440, 540, or 640 is formed on the dielectric substrate 420, 520, or 620 and is connected to the signal conversion portion 430, 530, or 630.

Figure 7:
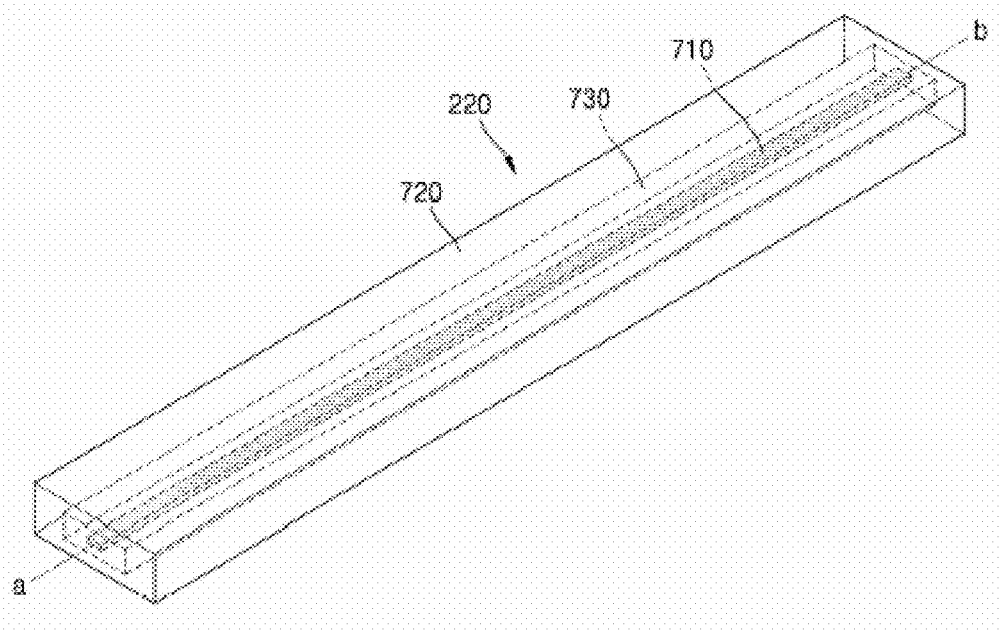
FIG. 7 is a perspective view illustrating a transmission line (flat cable) which is an element of one embodiment of a low-loss and flexible transmission line-integrated antenna for an mmWave band used in a transmission line-integrated multi-port antenna according to the present invention.
Figure 8:
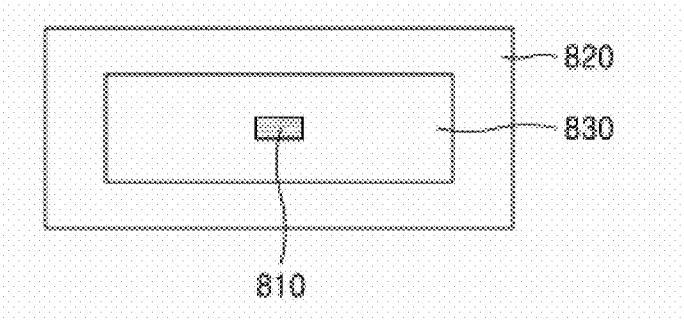
FIG. 8 is a front view of a transmission line which is an element of one embodiment of a low-loss and flexible transmission line-integrated antenna for an mmWave band used in a transmission line-integrated multi-port antenna according to the present invention.

FIG. 7 illustrates a flat cable type transmission line included in an example of the low-loss and flexible transmission line-integrated antenna for an mmWave band which is an element of the present invention. FIG. 8 is a front view illustrating a transmission line (flat cable) included in an example of the low-loss and flexible transmission line-integrated antenna for an mmWave band according to the present invention.

Referring to FIGS. 1A to 8, the transmission line 120, 220, or 320 includes a central conductor 710 or 810, an external conductor 720 or 820, and a dielectric 730 or 830.

One end of the central conductor 710 or 810 is connected to the electricity feeding portion 440, 540, or 640 of the antenna 110, 210, or 310 and transmits, as a signal line, the transmitted or received electrical signal. The external conductor 720 or 820 has the same axis as that of the central conductor 710 or 810 and shields the central conductor 710 or 810 in an axial direction a-b of the central conductor 710 or 810. The dielectric 730 or 830 is formed between the central conductor and the external conductor in the axial direction.

The dielectric substrate 420, 520, or 620 used in the antenna 110, 210, or 310 and the dielectric 730 or 830 used in the transmission line 120, 220, or 320 may have a sheet shape including a nanostructured material formed by electrospinning a resin in a variety of phases (solid, liquid, and gas) at a high voltage.

Figure 9:
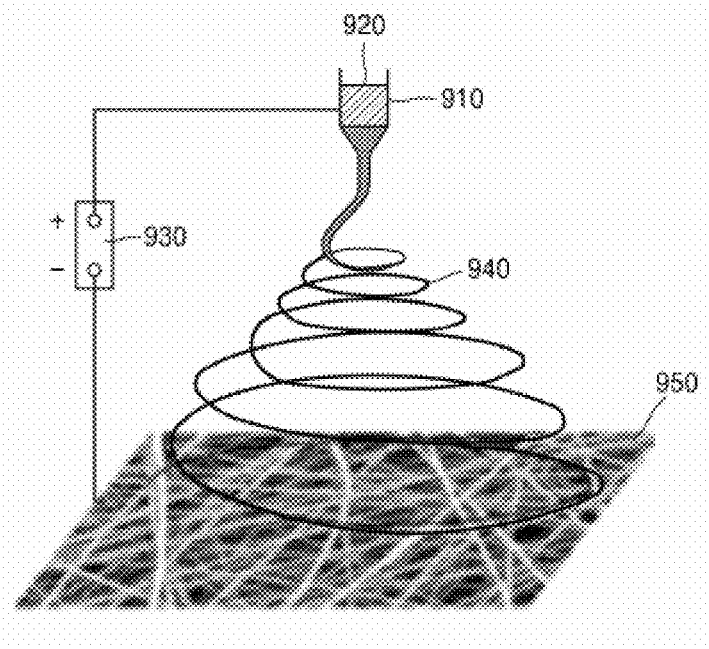
FIG. 9 illustrates an example of an apparatus for manufacturing nanoflon through electrospinning.

The nanostructured material is used as a dielectric material included in the antenna and the transmission line in the low-loss and flexible transmission line-integrated antenna for an mmWave band which is an element of the present invention. The dielectric material is formed by selecting an adequate resin among resins in a variety of phases (solid, liquid, and gas) and electrospinning the resin at a certain high voltage and will be referred to as nanoflon hereinafter. FIG. 9 illustrates an example of an apparatus which manufactures nanoflon through electrospinning. When a polymer solution 920 including polymers is injected into an injector 910, a high voltage 930 is applied to a space between the injector 910 and a substrate on which spinning is performed, and the polymer solution flows at a certain speed thereinto, as electricity is applied to a liquid suspended from an end of a capillary due to surface tension, a nanosized thread 940 is formed, and as time passes, non-woven nanofibers 950 having a nanostructure are accumulated. A material formed of the accumulated nanofibers as described above is nanoflon. As a polymer material used for electrospinning, for example, there are polycarbonate (PC), polyurethane (PU), polyvinylidene difluoride (PVDF), polyethersulfone (PES), polyimide (nylon), polyacrylonitrile (PAN), and the like.

Since nanoflon has low dielectric permittivity and a large amount of air, nanoflon may be used as a dielectric of a transmission line and a dielectric substrate of an antenna. Relative dielectric permittivity (Er) of nanoflon used in the present invention is about 1.56, and Tan δ which is a dielectric loss tangent value is about 0.0008. In comparison to those of polyimide having relative dielectric permittivity of 4.3 and a dielectric loss tangent value of 0.004, the relative dielectric permittivity and dielectric loss tangent value of the nanoflon are significantly low. Also, the transmission line-integrated antenna according to the present invention may use a low-loss and flexible material so as to be flexible and to provide flexibility in installation even in a small space of a smart phone.

Meanwhile, the dielectric used in FIGS. 1A to 8 may be a nanostructured nanosheet dielectric formed by electrospinning a resin in a variety of phases at a high voltage. That is, the dielectric used herein is a low-loss nanosheet material including a lot of air layers between dielectrics which is formed by electrospinning a dielectric resin such as PC, PU, PVDF, PES, nylon, PAN, and the like at a high voltage instead of a material including only a dielectric material without an air layer in a dielectric such as existing polyimide (PI) and liquid crystal polymer (LCP)-based materials.

A conductor included in a component of the low-loss and flexible transmission line-integrated antenna for an mmWave band shown in FIGS. 1A to 8 may be formed using a variety of methods such as etching, printing, depositing, and the like. Also, the conductor and the nanosheet dielectric included in the low-loss and flexible transmission line-integrated antenna for an mmWave band shown in FIGS. 1A to 8 include not only a single lamination structure but also a multilayer structure in which a plurality of layers are repetitively stacked so as to transmit and receive a multiple signal at the same time. Also, for a bonding structure increasing reliability between the conductor and the nanosheet dielectric, the conductor and the nanosheet dielectric may be connected using a bonding solution or a bonding sheet having a structure having low relative dielectric permittivity and a low dielectric loss of a thin film layer.

Also, the low-loss and flexible transmission line-integrated single-port antenna used as an element of to the present invention includes a microstrip patch signal radiator, a variety of shapes of patch type antenna radiator structures, or a diagonal line type patch antenna structure. An antenna radiator patch may be located on an uppermost end surface, a nanosheet dielectric having a certain thickness may be formed on a bottom surface of the antenna radiator patch, and a ground plate formed of a metal may be formed on a lowermost end surface. Particularly, for efficient combination between each conductor and the nanosheet dielectric, a bonding force may be reinforced using a low-loss dielectric bonding sheet or a bonding solution and a conductor may be deposited on a nanosheet dielectric to be utilized.

Also, a transmission line integrated with an antenna in the low-loss and flexible transmission line-integrated single-port antenna may use same nanosheet dielectric as a dielectric. Referring to FIG. 1C, the transmission line 120 includes a nanosheet dielectric 126 having a certain thickness, conductors 128 and 129 formed on a top surface and a bottom surface of the nanosheet dielectric 126, and a stripline signal line 124 formed as a signal line in a center of the nanosheet dielectric 126 and the conductors 128 and 129. A plurality of via holes 122 may be formed between a conductor 128 surface formed above the nanosheet dielectric 126 and a conductor 129 surface formed below the nanosheet dielectric 126. That is, the low-loss and flexible transmission line-integrated antenna according to the present invention may include a stripline structure in which the plurality of via holes are formed along a longitudinal edge of the transmission line 120 in a direction parallel to the signal line 124. The stripline signal line 124 is directly connected to a radiator patch conductor 112 of the antenna.

The plurality of via holes 122 are configured to prevent a leakage of the signal line and transmission/reception of noise and provides an excellent noise cut property with respect to a broadband including an mmWave band using an SIW structure.

Figure 10:
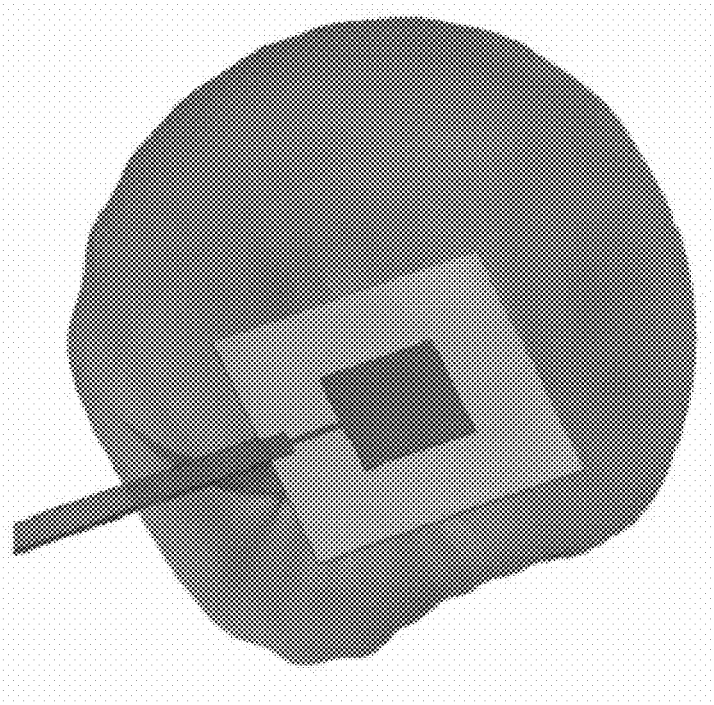
FIG. 10 illustrates a beam pattern (radiation pattern) of a transmission line-integrated patch antenna as an example of a low-loss and flexible transmission line-integrated antenna for an mmWave band used in a multi-port antenna according to the present invention.

FIG. 10 illustrates a beam pattern (radiation pattern) of a transmission line-integrated patch antenna as an example of the low-loss and flexible transmission line-integrated single-port antenna for an mmWave band used in the low-loss and flexible transmission line-integrated multi-port antenna according to the present invention. The beam pattern is electric field strength of a radiated electromagnetic wave and indicates directivity as shown in FIG. 10.

Figure 11:
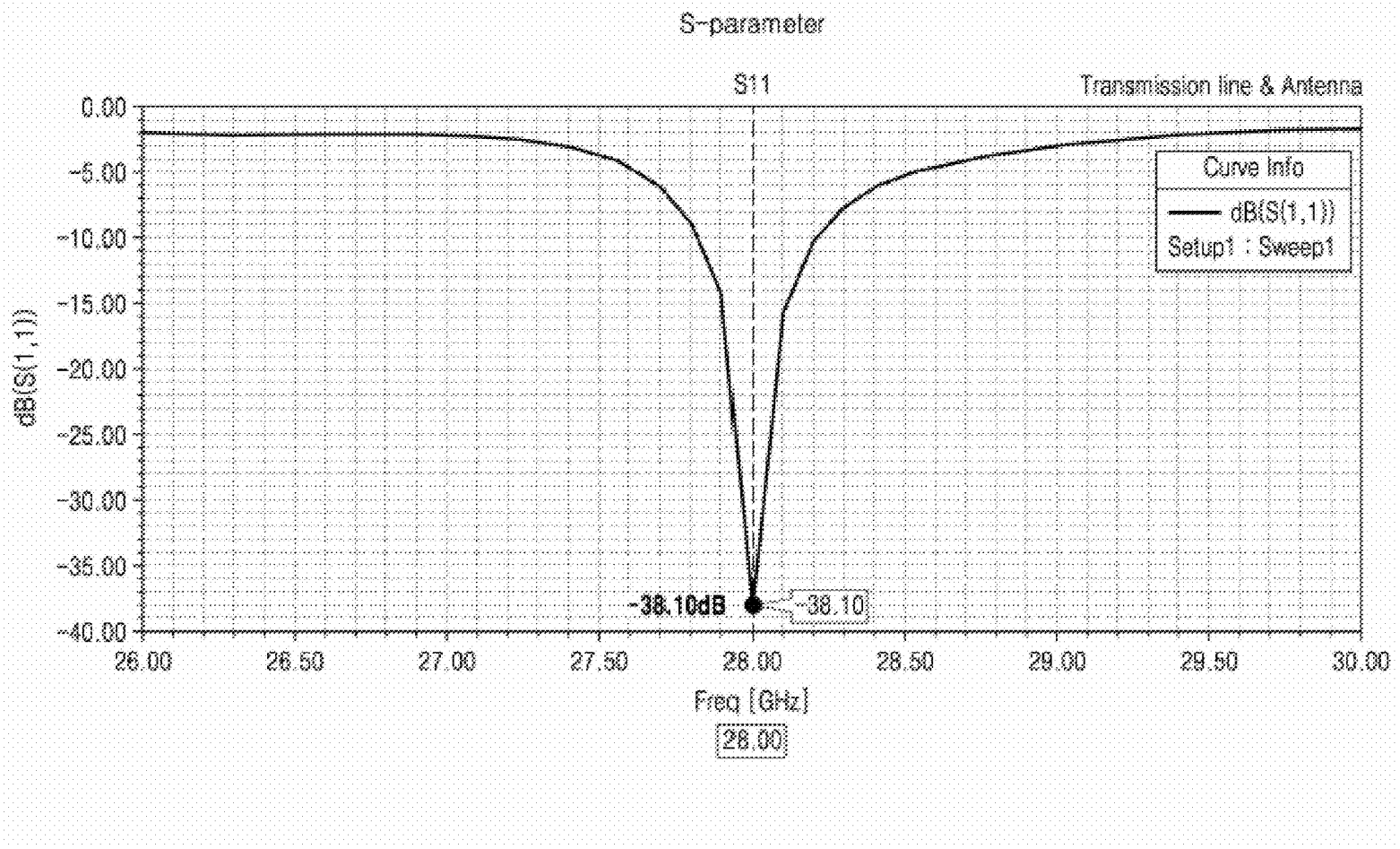
FIG. 11 illustrates an input reflection coefficient S11 according to a frequency of a transmission line-integrated patch antenna as an example of a low-loss and flexible transmission line-integrated antenna for an mmWave band used in a transmission line-integrated multi-port antenna according to the present invention.

FIG. 11 illustrates a property of an input reflection parameter S11 according to a frequency of a transmission line-integrated patch antenna as an example of a low-loss and flexible transmission line-integrated antenna for an mmWave band used in a transmission line-integrated multi-port antenna according to the present invention. Referring to FIG. 11, it may be seen that, in the transmission line-integrated patch antenna according to one embodiment of the present invention, an S11 value decreases and signal power input into the antenna is reflected, does not return, is maximally radiated outside through the antenna, has high radiation efficiency, and is well matched at a frequency of 28 GHz that is a 5G communication frequency.

Figure 12:
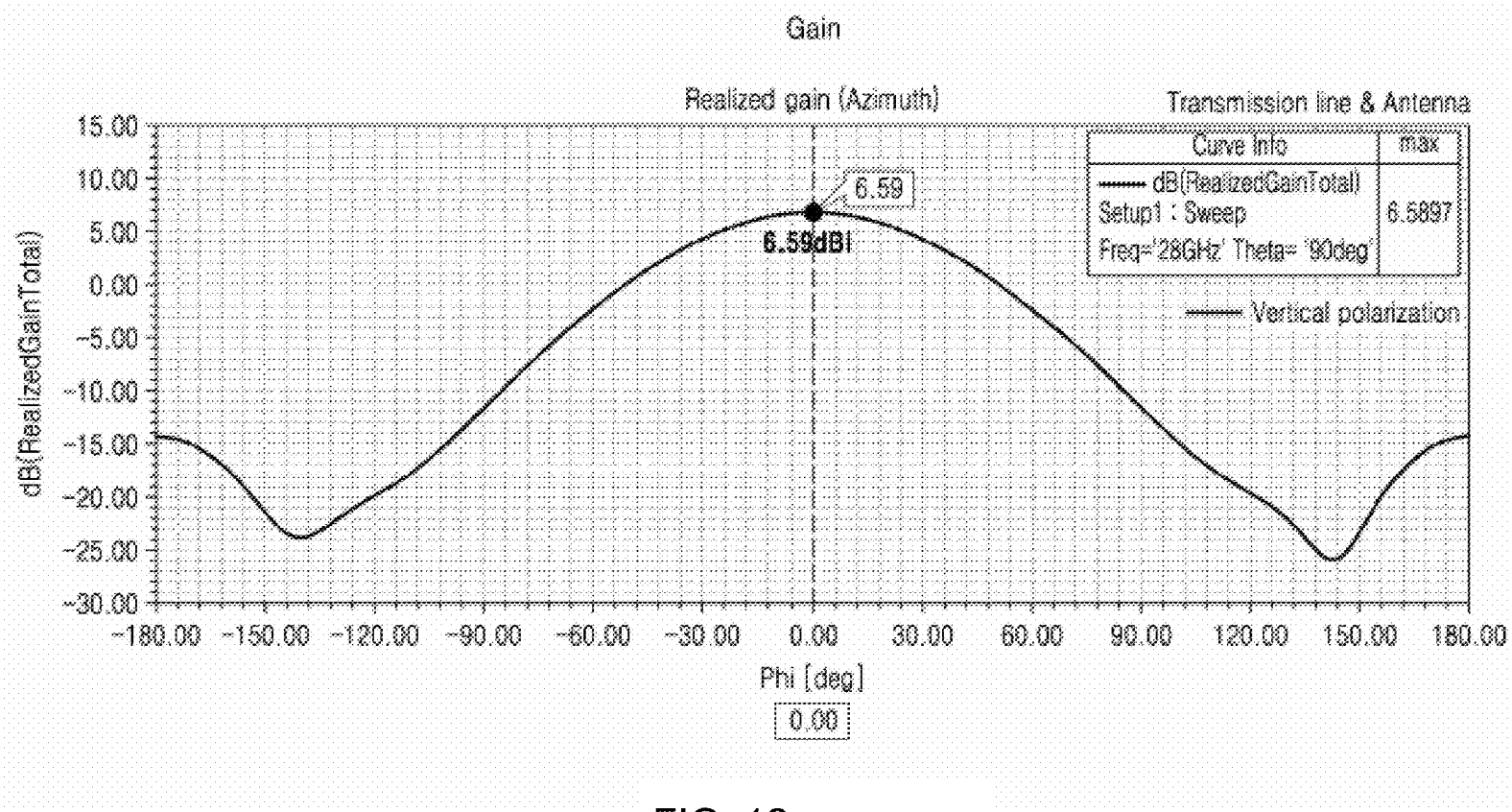
FIG. 12 illustrates a gain property of a transmission line-integrated patch antenna as an example of the low-loss and flexible transmission line-integrated antenna for an mmWave band used in the transmission line-integrated multi-port antenna according to the present invention.

FIG. 12 illustrates a gain property of a transmission line-integrated patch antenna as an example of the low-loss and flexible transmission line-integrated antenna for an mmWave band used in the transmission line-integrated multi-port antenna according to the present invention. Referring to FIG. 12, it may be seen that a gain property of vertical polarization is about 6.6 dBi at 0 radian which is a very high antenna gain property.

Meanwhile, the low-loss and flexible transmission line-integrated single-port antenna for an mmWave band includes not only a patch antenna or a microstrip patch antenna but also an antenna and a transmission line using dielectrics. For example, the antenna used as an element of the present invention may be configured as a dipole antenna or a monopole antenna. Also, the antenna is a built-in antenna built in a mobile communication terminal and may be applied to a planar inverted F antenna (PIFA).

Figure 13:
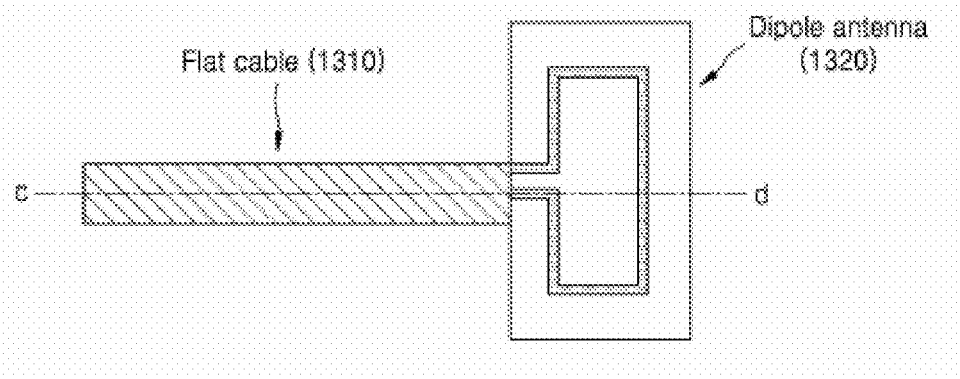
FIG. 13 is a plan view of a transmission line-integrated dipole antenna as an example of the low-loss and flexible transmission line-integrated antenna for an mmWave band used in the transmission line-integrated multi-port antenna according to the present invention.
Figure 14:
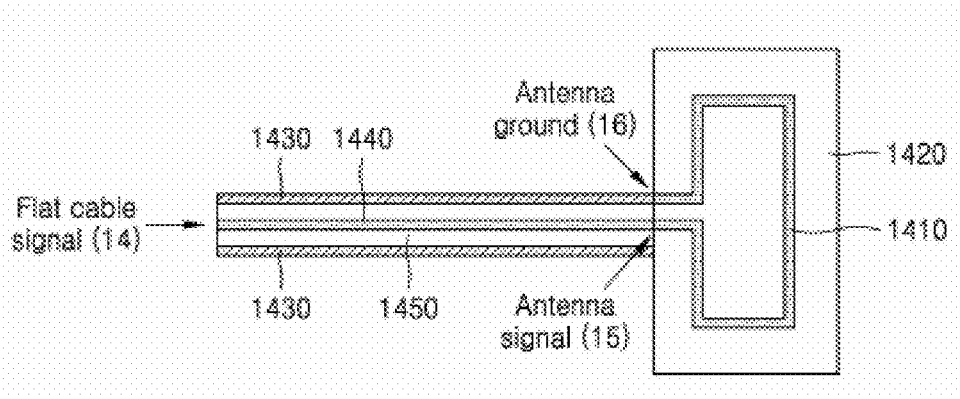
FIG. 14 is an axial cross-sectional view of a transmission line-integrated dipole antenna as an example of the low-loss and flexible transmission line-integrated antenna for an mmWave band used in the present invention.

FIG. 13 is a plan view of a transmission line-integrated dipole antenna as another example of the low-loss and flexible transmission line-integrated single-port antenna for an mmWave band used in the embodiment of the present invention. FIG. 14 is an axial (c-d of FIG. 13) cross-sectional view of a transmission line-integrated dipole antenna as another example of a low-loss and flexible transmission line-integrated single-port antenna for an mmWave band used in an embodiment according to the present invention.

Referring to FIGS. 13 and 14, the transmission line-integrated dipole antenna includes a flat cable 1310 that is a transmission line and a dipole antenna 1320 integrated with the flat cable 1310. Also, the dipole antenna 1320 includes a dipole type signal conversion portion 1410 and a dielectric 1420, and the transmission line 1310 includes a central conductor 1440 which transmits a signal, an external conductor 1450, and a dielectric 1450 which is formed of a dielectric material having low dielectric permittivity and a low loss between the central conductor and the external conductor.

The transmission line-integrated dipole antenna usable in the embodiment of the present invention includes one end 15 connected to a signal line of the flat cable which is the transmission line 1310 and another end 16 connected to a ground line of the antenna.

Figure 15:
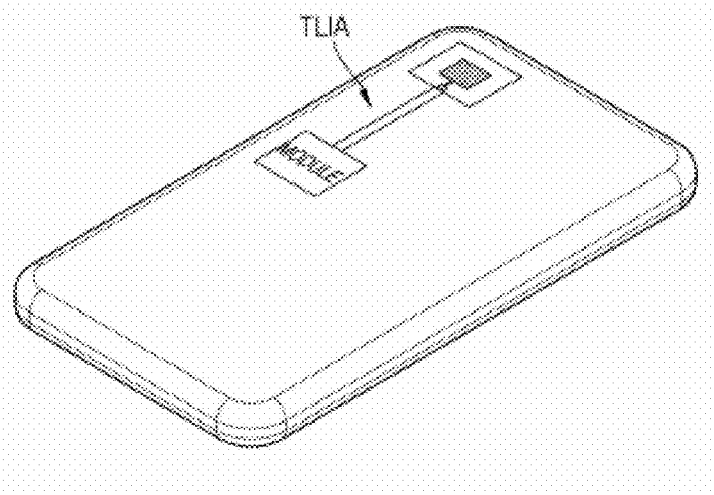
FIG. 15 illustrates an example of a mobile communication device in which a low-loss and flexible transmission line-integrated single-port antenna for an mmWave band used in an embodiment of the present invention is mounted.

Also, FIG. 15 illustrates an example of a mobile communication device in which the low-loss and flexible transmission line-integrated single-port antenna for an mmWave band used in the embodiment of the present invention is mounted. Referring to FIG. 15, the mobile communication terminal includes a low-loss and flexible transmission line-integrated single-port antenna TLIA for an mmWave band according to the present invention which is connected to a circuit module of the mobile communication terminal, transmits and receives an electrical signal, and externally radiates electromagnetic waves through an antenna.

Meanwhile, the low-loss and flexible transmission line-integrated multi-port antenna for an mmWave band according to the present invention which includes the above-described low-loss and flexible transmission line-integrated single-port antenna will be described.

Figure 16:
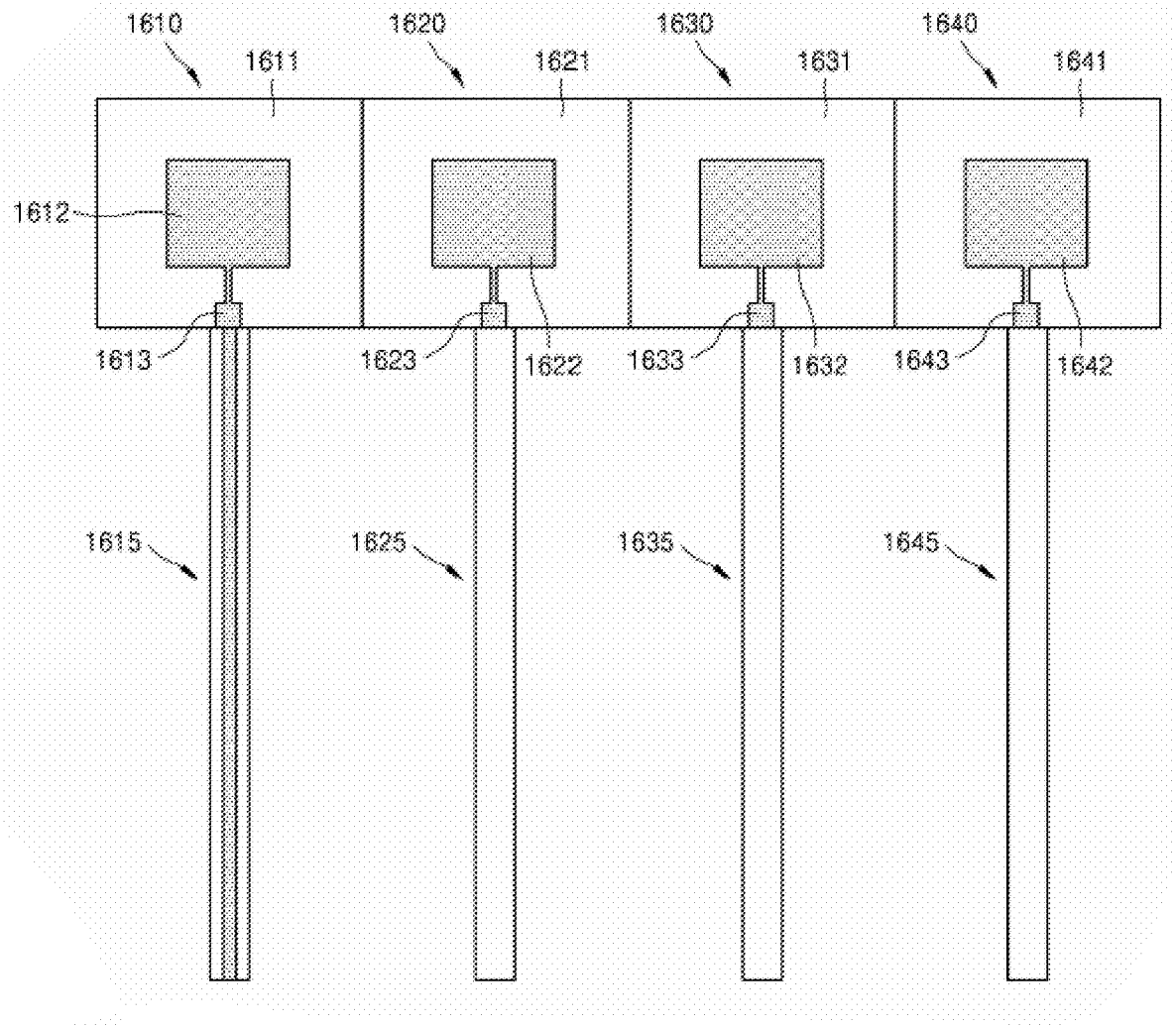
FIG. 16 is a plan view illustrating one example of a multi-port antenna having a vertical structure as the low-loss and flexible transmission line-integrated multi-port antenna for an mmWave band according to the present invention.
Figure 17:
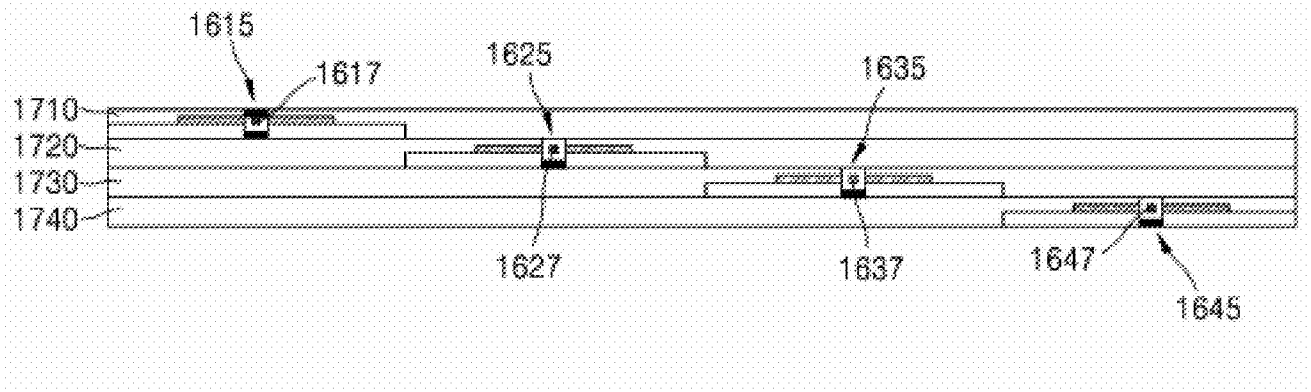
FIG. 17 is a side view illustrating one example of the multi-port antenna having the vertical structure as the low-loss and flexible transmission line-integrated multi-port antenna for an mmWave band according to the present invention.

FIG. 16 is a plan view illustrating one example of a multi-port antenna having a vertical structure as the low-loss and flexible transmission line-integrated multi-port antenna for an mmWave band according to the present invention. FIG. 17 is a side view illustrating one example of the multi-port antenna having the vertical structure as the low-loss and flexible transmission line-integrated multi-port antenna for an mmWave band according to the present invention.

Referring to FIGS. 16 and 17, the low-loss and flexible transmission line-integrated multi-port antenna for an mmWave band according to the present invention includes a plurality of antennas 1610, 1620, 1630, and 1640 and a plurality of transmission lines 1615, 1625, 1635, and 1645.

The plurality of antennas 1610, 1620, 1630, and 1640 are arranged on different substrate layers 1710, 1720, 1730, and 1740 and form a multi port, for example, four ports.

The plurality of transmission lines 1615, 1625, 1635, and 1645 correspond to the plurality of antennas 1610, 1620, 1630, and 1640 and are integrated with electricity feeding portions 1613, 1623, 1633, and 1643, respectively, to which central conductors 1617, 1627, 1637, and 1647 used as signal lines of the transmission lines correspond. The central conductors 1617, 1627, 1637, and 1647 of the transmission lines are arranged on the different layers 1710, 1720, 1730, and 1740.

As described above with reference to FIGS. 1A to 18, each of the plurality of antennas 1610, 1620, 1630, and 1640 includes a dielectric substrate 1611, 1621, 1631, 1641, 420, 520, or 620, a signal conversion portion 1612, 1622, 1632, 1642, 430, 530, or 630, and an electricity feeding portion 1613, 1623, 1633, 1643, 440, 540, or 640.

The dielectric substrate 1611, 1621, 1631, 1641, 420, 520, or 620 is formed of a dielectric having a certain thickness on the ground plate 410 or 610. The signal conversion portion 1612, 1622, 1632, 1642, 530, or 630 is formed on the dielectric substrate 1611, 1621, 1631, 1641, 420, 520, or 620 and converts an electrical signal of a mobile communication device into an electromagnetic wave signal and radiates the electromagnetic wave signal into the air or receives and converts an electromagnetic wave signal in the air into an electrical signal of a mobile communication terminal. The electricity feeding portion 1613, 1623, 1633, 440, 540, or 630 is formed on the dielectric substrate 1611, 1621, 1631, 1641, 420, 520, or 620 and is connected to the signal conversion portion 1612, 1622, 1632, 1642, 430, 530, or 630.

Also, each of the plurality of transmission lines 1615, 1625, 1635, and 1645 includes the central conductor 1617, 1627, 1637, 710, or 810, the external conductor 720 or 820, and the dielectric 730 or 830.

One end of the central conductor 710 or 810 is integrated with the electricity feeding portion 1613, 1623, 1633, 1643, 440, 540, or 630 and transfers the transmitted or received electrical signal.

The external conductor 720 or 820 has the same axis as that of the central conductor 1617, 1627, 1637, 1647, 710, or 810 and shields the central conductor 1617, 1627, 1637, 1647, 710, or 810 in an axial direction of the central conductor 1617, 1627, 1637, 1647, 710, or 810.

The dielectric 730 or 830 is formed between the central conductor 1617, 1627, 1637, 1647, 710, or 810 and the external conductor 720 or 820 in the axial direction.

The dielectric 730 or 830 may be a nanostructured sheet material formed by electrospinning a resin at a high voltage as described above with reference to FIG. 9.

Figure 18:
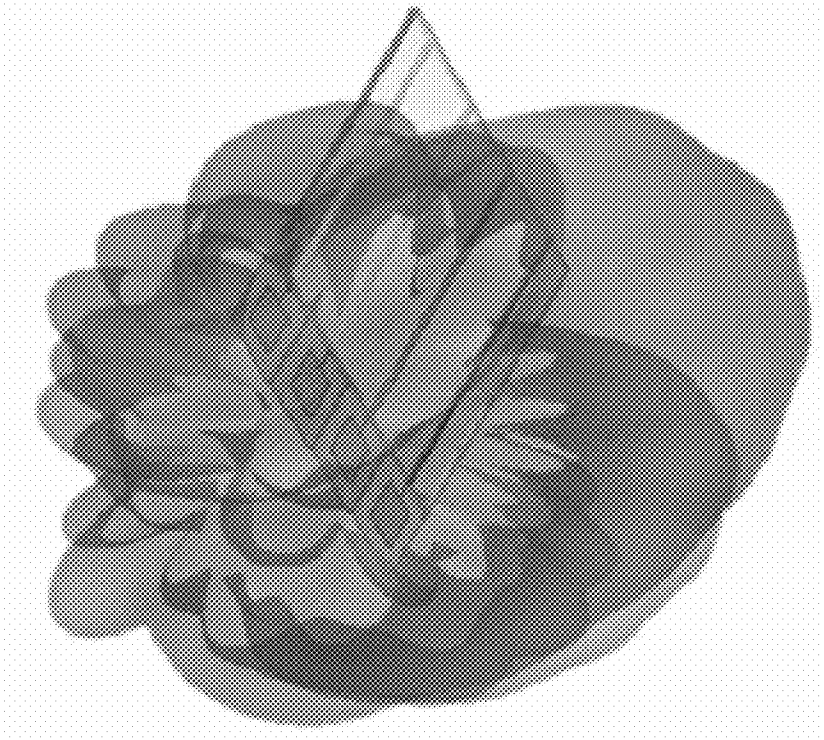
FIG. 18 illustrates a beam pattern (radiation pattern) with respect to one example of the multi-port antenna having the vertical structure as the low-loss and flexible transmission line-integrated multi-port antenna for an mmWave band according to the present invention.

FIG. 18 illustrates a beam pattern (radiation pattern) with respect to one example of the multi-port antenna having the vertical structure as the low-loss and flexible transmission line-integrated multi-port antenna for an mmWave band according to the present invention. The beam pattern is electric field strength of a radiated electromagnetic wave. Referring to FIG. 18, synthetic electric field strength of the multi-port antenna is greater than electric field strength of the single-port antenna shown in FIG. 10 and may radiate an electromagnetic wave signal into the air longer distance.

Figure 19:
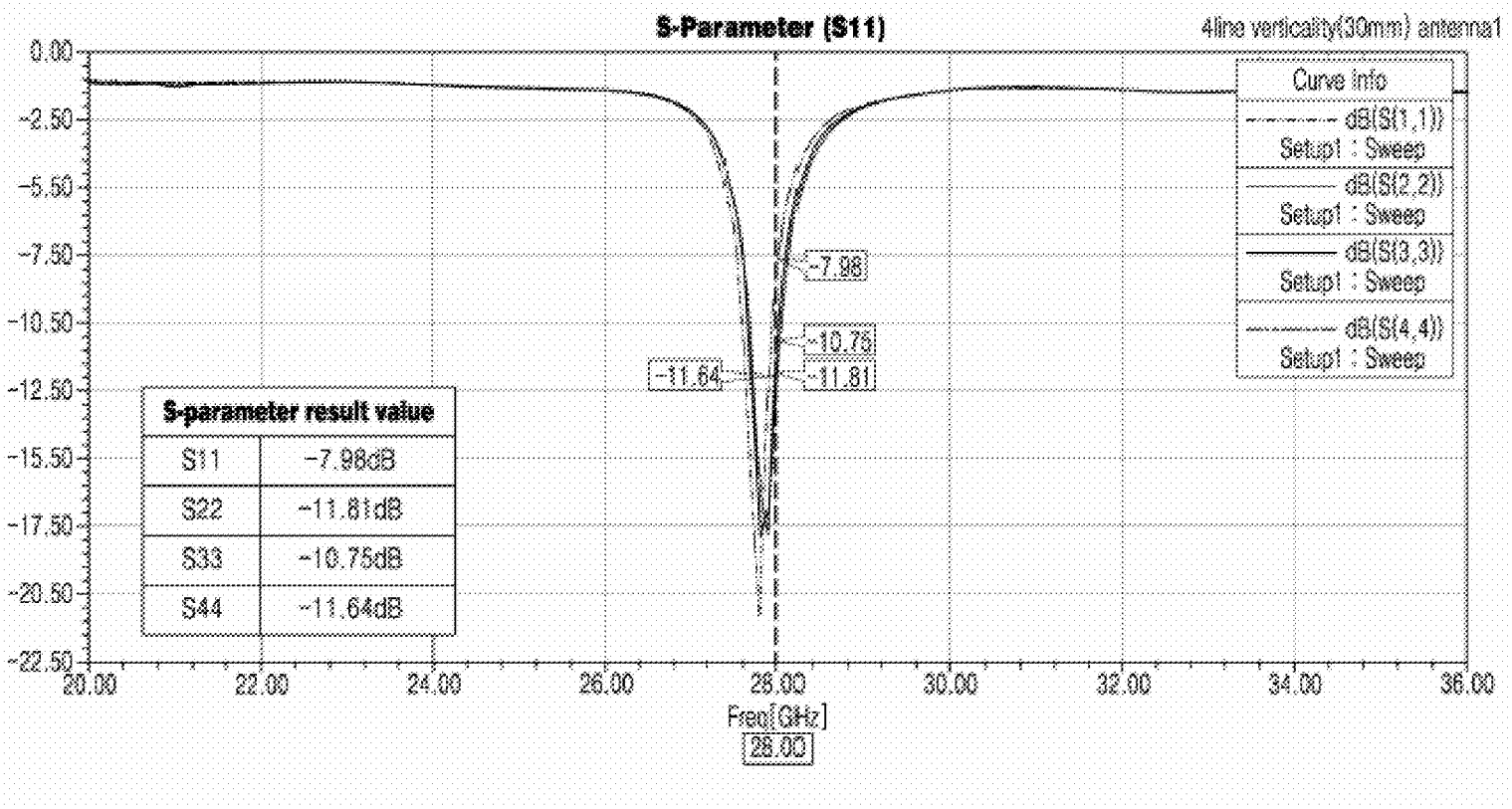
FIG. 19 illustrates a property of an input reflection parameter S11 according to a frequency with respect to one example of the multi-port antenna having the vertical structure as the low-loss and flexible transmission line-integrated multi-port antenna for an mmWave band according to the present invention.

FIG. 19 illustrates a property of an input reflection parameter S11 according to a frequency with respect to one example of the multi-port antenna having the vertical structure as the low-loss and flexible transmission line-integrated multi-port antenna for an mmWave band according to the present invention. Referring to FIG. 19, it may be seen that the transmission line-integrated multi-port patch antenna according to one embodiment of the present invention has excellent impedance with respect to signal power input into the antenna and an excellent reflection parameter at a frequency of 28 GHz which is a 5G communication frequency.

Figure 20:
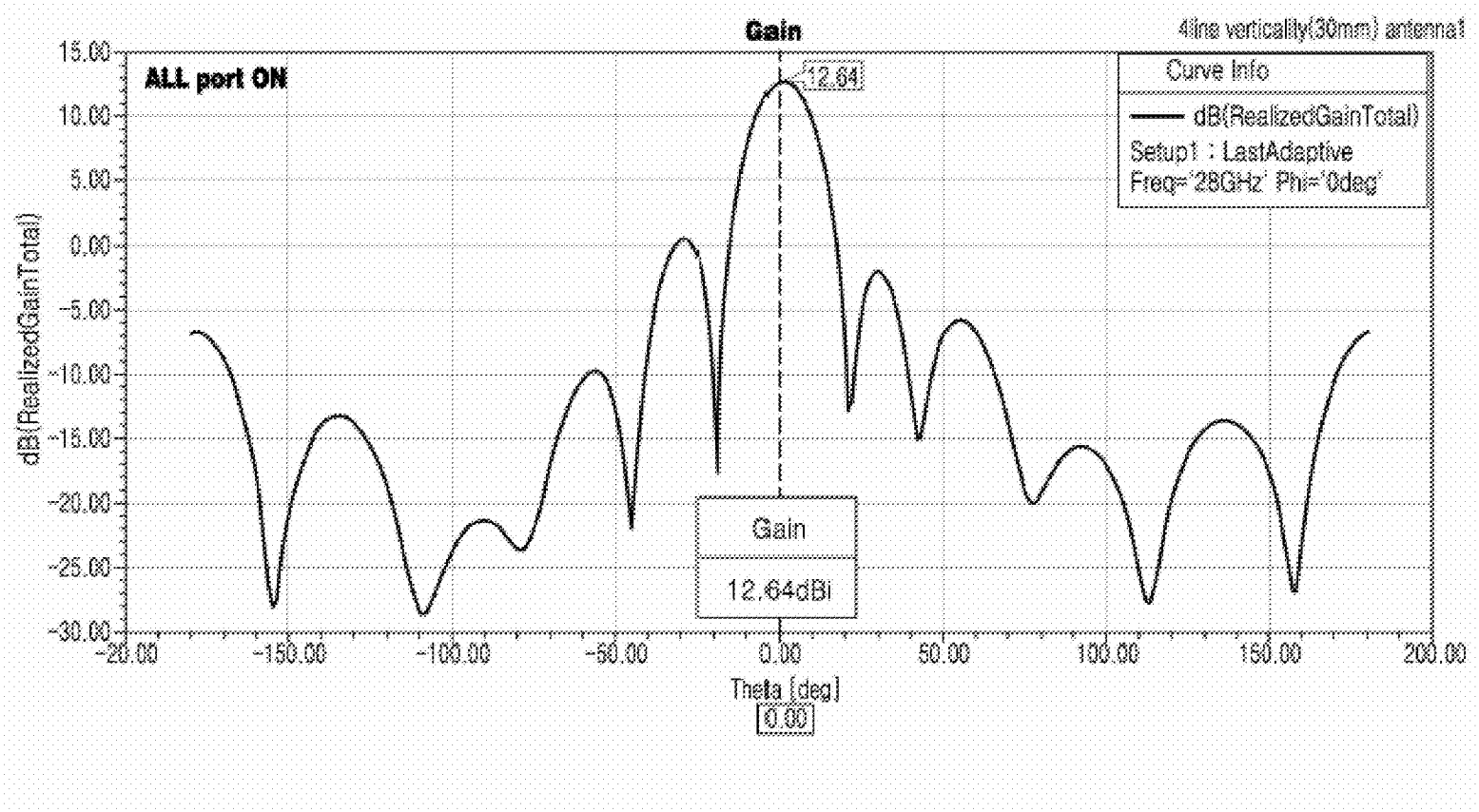
FIG. 20 illustrates a gain property with respect to one example of the multi-port antenna having the vertical structure as the low-loss and flexible transmission line-integrated multi-port antenna for an mmWave band according to the present invention.

FIG. 20 illustrates a gain property with respect to one example of the multi-port antenna having the vertical structure as the low-loss and flexible transmission line-integrated multi-port antenna for an mmWave band according to the present invention. Referring to FIG. 20, it may be seen that when an input signal is applied to the multi port, a gain property of vertical polarization is about 12.64 dBi at 0 radian which is a very high antenna gain property.

Figure 21:
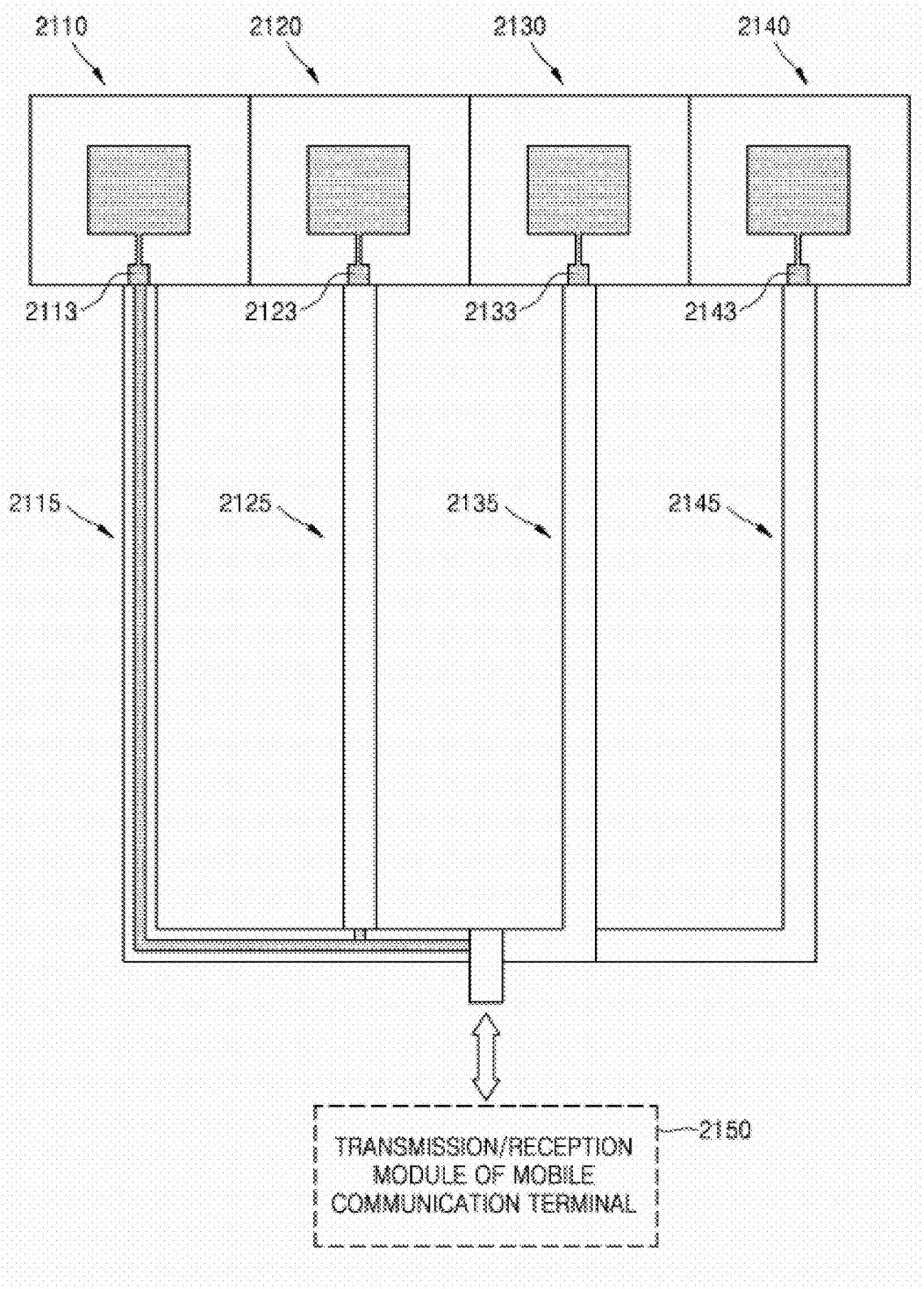
FIG. 21 is a plan view illustrating one embodiment of the multi-port antenna having the vertical structure as the low-loss and flexible transmission line-integrated multi-port antenna for an mmWave band according to the present invention.
Figure 22:
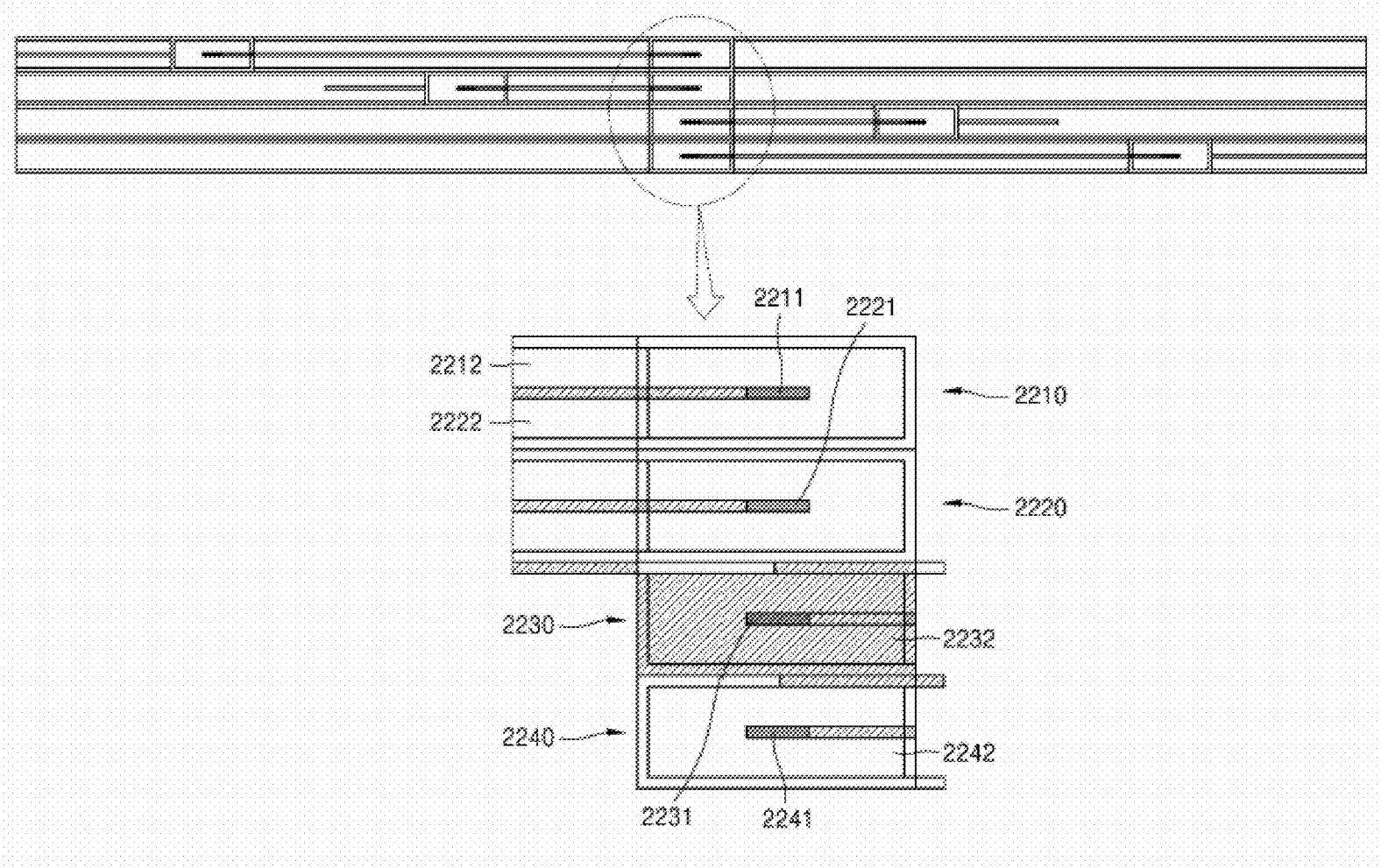
FIG. 22 is a side view illustrating one embodiment of the multi-port antenna having the vertical structure as the low-loss and flexible transmission line-integrated multi-port antenna for an mmWave band according to the present invention.

FIG. 21 is a plan view illustrating a first embodiment of the multi-port antenna having the vertical structure as the low-loss and flexible transmission line-integrated multi-port antenna for an mmWave band according to the present invention. FIG. 22 is a side view illustrating the first embodiment of the multi-port antenna having the vertical structure as the low-loss and flexible transmission line-integrated multi-port antenna for an mmWave band according to the present invention.

The first embodiment of the transmission line-integrated multi-port antenna having the vertical structure according to the present invention will be described below with reference to FIGS. 21 and 22. The first embodiment shown in FIG. 21 includes a plurality of antennas 2110, 2120, 2130, and 2140 and a plurality of transmission lines 2115, 2125, 2135, and 2145. The plurality of antennas 2110, 2120, 2130, and 2140 are equal to the plurality of antennas 1610, 1620, 1630, and 1640 shown in FIG. 16, and the plurality of transmission lines 2115, 2125, 2135, and 2145 are equal to the plurality of 1615, 1625, 1635, and 1645 shown in FIG. 16.

However, in the second embodiment of the multi-port antenna having the vertical structure as the low-loss and flexible transmission line-integrated multi-port antenna for an mmWave band according to the present invention, a central conductor at one end of each of the transmission lines 2115, 2125, 2135, and 2145 is integrated with an electricity feeding portion of the corresponding antenna and a central conductor 2211, 2221, 2231, or 2241 at the other end 2210, 2220, 2230, or 2240 of each of the transmission lines 2115, 2125, 2135, and 2145 is connected to a signal line of a transmission/reception module 2150 of a mobile communication terminal and vertically arranged on a different layer 2212, 2222, 2232, or 2242.

As shown in FIG. 22, the central conductors 2211, 2221, 2231, and 2241 of the other ends of the transmission lines are spaced apart from each other in a vertical direction on different layers at a position 2160 close to the transmission/reception module 2150 and are close and integrally connected to electricity feeding portions 2113, 2123, 2133, and 2143 of the corresponding antennas while being spaced apart.

Figure 23:
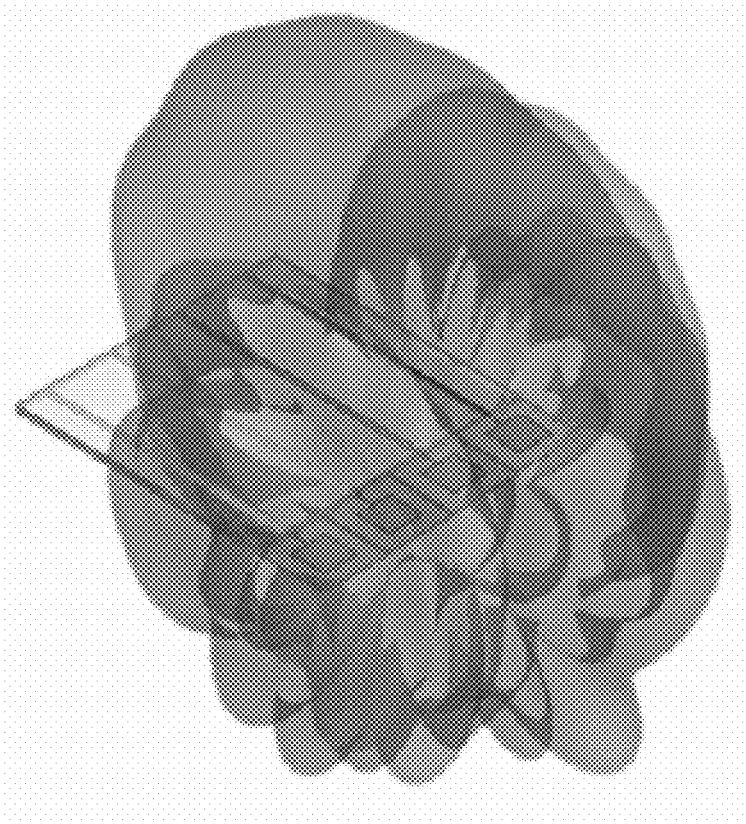
FIG. 23 illustrates a beam pattern (radiation pattern) with respect to one embodiment of the multi-port antenna having the vertical structure as the low-loss and flexible transmission line-integrated multi-port antenna for an mmWave band according to the present invention.

FIG. 23 illustrates a beam pattern (radiation pattern) with respect to the first embodiment of the multi-port antenna having the vertical structure as the low-loss and flexible transmission line-integrated multi-port antenna for an mmWave band according to the present invention. The beam pattern is electric field strength of a radiated electromagnetic wave. Referring to FIG. 23, synthetic electric field strength of the multi-port antenna is greater than electric field strength of the single-port antenna shown in FIG. 10 and may radiate an electromagnetic wave signal into the air longer distance.

Figure 24:
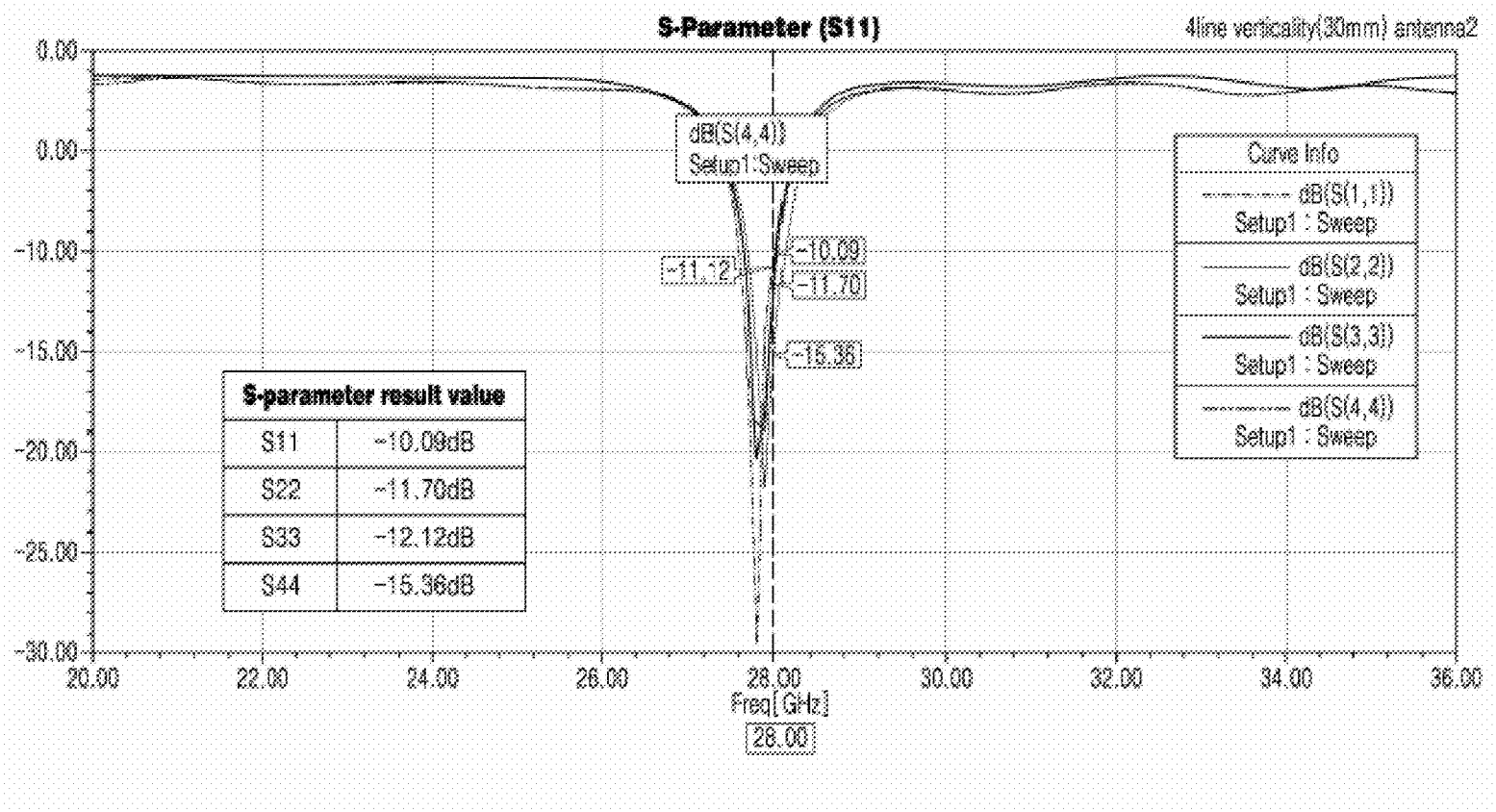
FIG. 24 illustrates a property of an input reflection parameter S11 according to a frequency with respect to one embodiment of the multi-port antenna having the vertical structure as the low-loss and flexible transmission line-integrated multi-port antenna for an mmWave band according to the present invention.

FIG. 24 illustrates a property of an input reflection parameter S according to a frequency with respect to a first embodiment of the multi-port antenna having the vertical structure as the low-loss and flexible transmission line-integrated multi-port antenna for an mmWave band according to the present invention. Referring to FIG. 24, it may be seen that the transmission line-integrated multi-port patch antenna according to one embodiment of the present invention has excellent impedance with respect to signal power input into the antenna and an excellent reflection parameter at a frequency of 28 GHz which is a 5G communication frequency.

Figure 25:
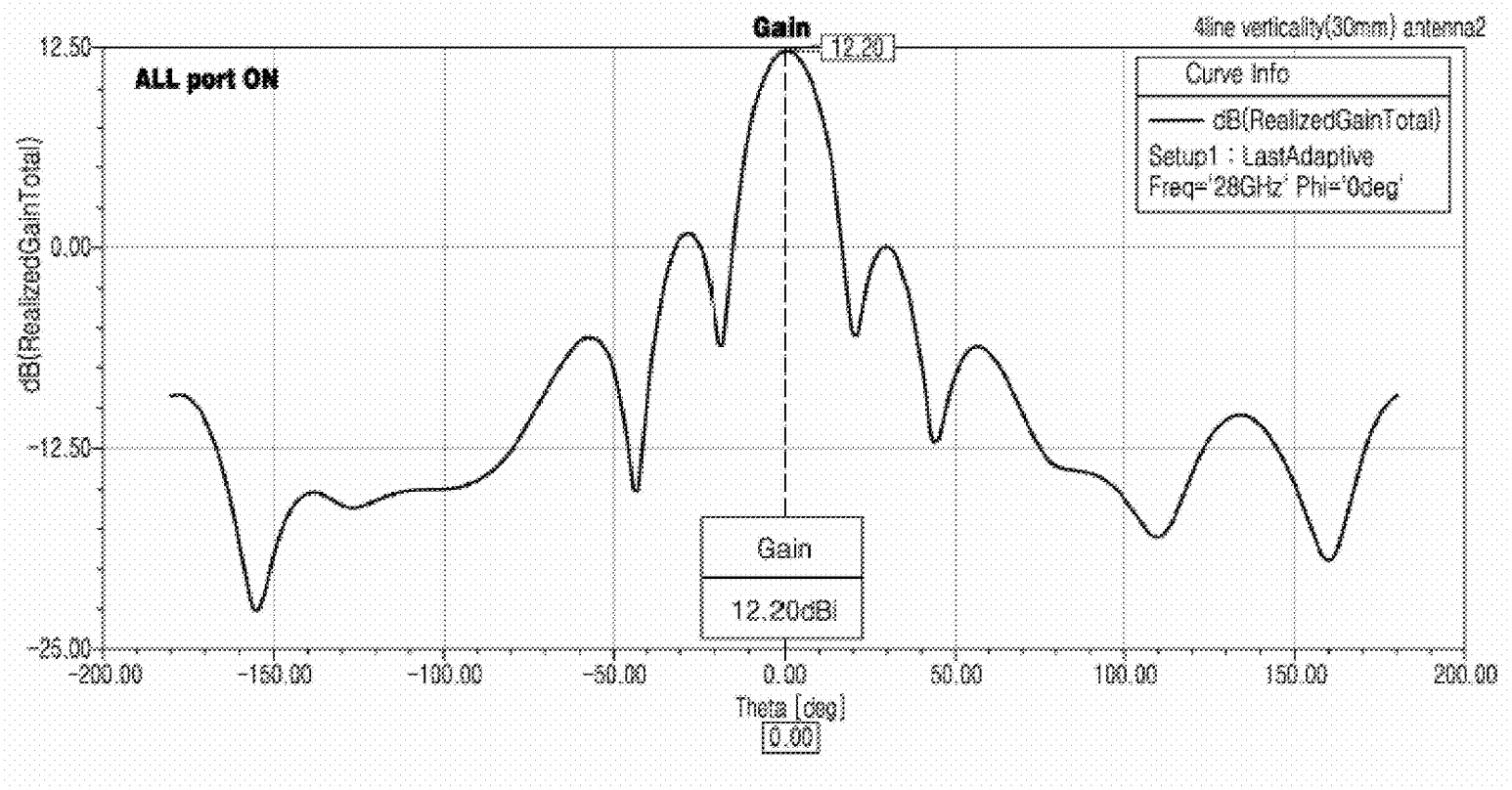
FIG. 25 illustrates a gain property with respect to one embodiment of the multi-port antenna having the vertical structure as the low-loss and flexible transmission line-integrated multi-port antenna for an mmWave band according to the present invention.

FIG. 25 illustrates a gain property with respect to the first embodiment of the multi-port antenna having the vertical structure as the low-loss and flexible transmission line-integrated multi-port antenna for an mmWave band according to the present invention. Referring to FIG. 25, it may be seen that when an input signal is applied to the multi port, a gain property of vertical polarization is about 12.20 dBi at 0 radian which is a very high antenna gain property.

Figure 26:
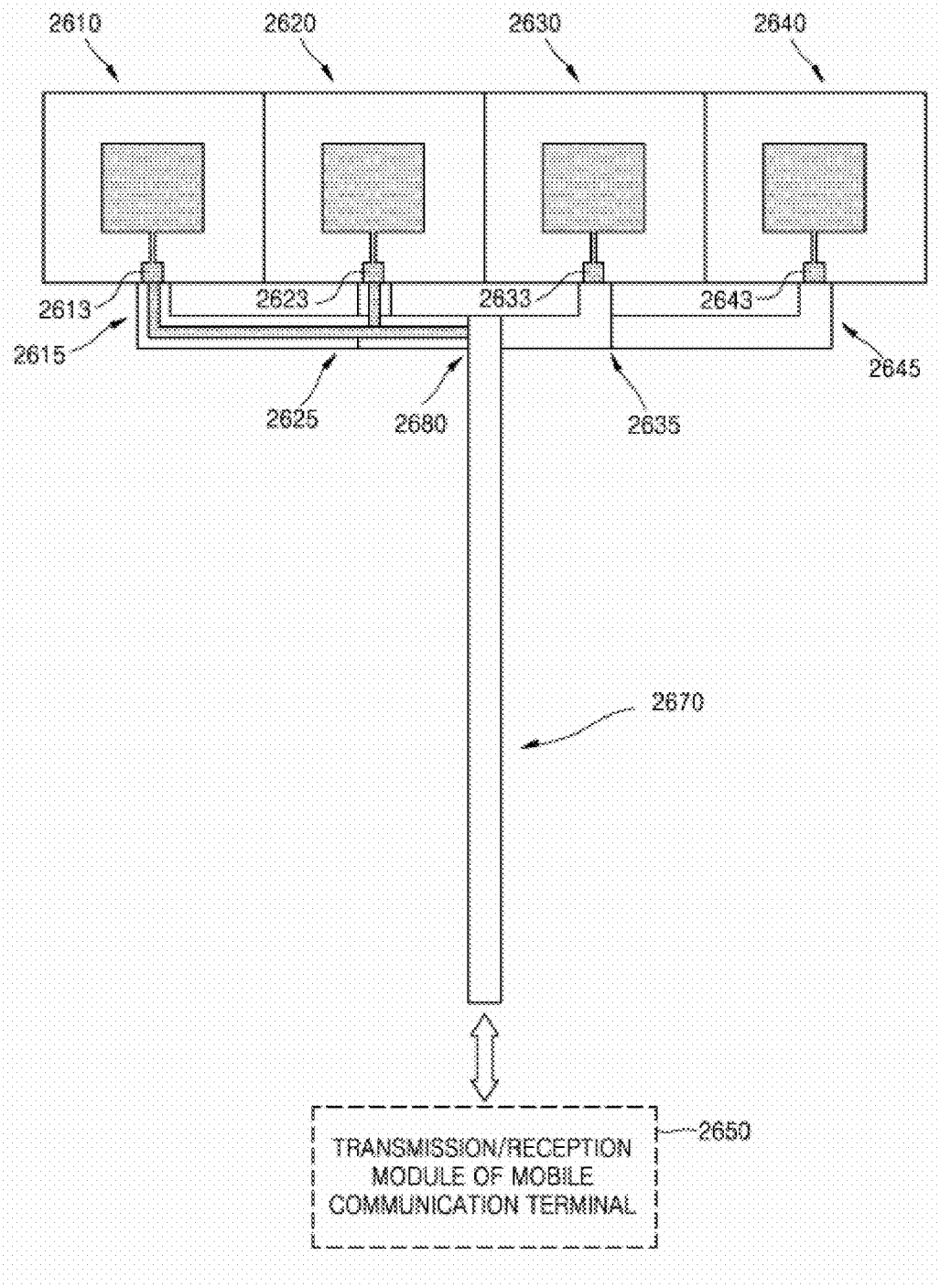
FIG. 26 is a plan view illustrating another embodiment of the multi-port antenna having the vertical structure as the low-loss and flexible transmission line-integrated multi-port antenna for an mmWave band according to the present invention.
Figure 27:
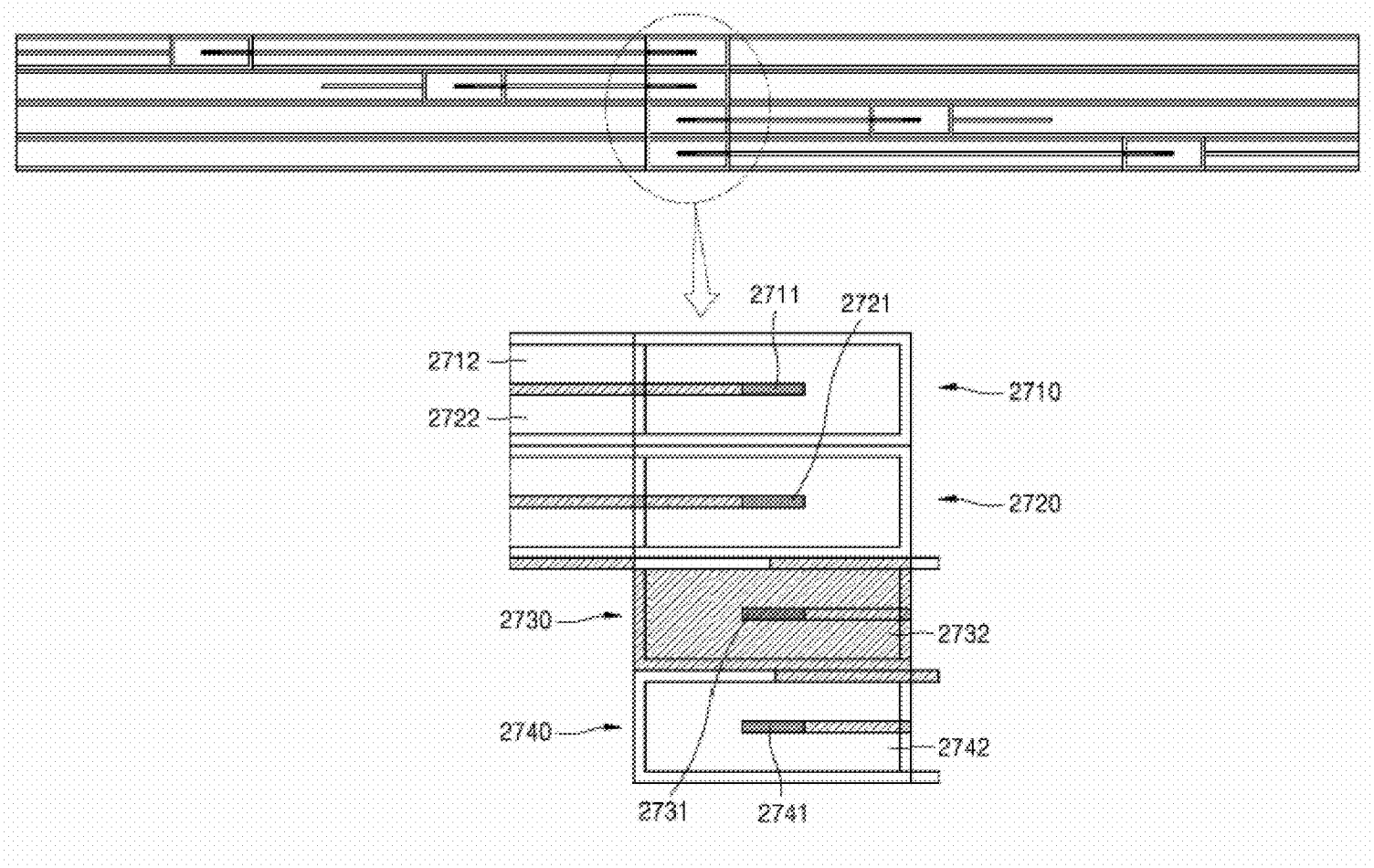
FIG. 27 is a side view illustrating another embodiment of the multi-port antenna having the vertical structure as the low-loss and flexible transmission line-integrated multi-port antenna for an mmWave band according to the present invention.

FIG. 26 is a plan view illustrating the second embodiment of the multi-port antenna having the vertical structure as the low-loss and flexible transmission line-integrated multi-port antenna for an mmWave band according to the present invention. FIG. 27 is a side view illustrating the second embodiment of the multi-port antenna having the vertical structure as the low-loss and flexible transmission line-integrated multi-port antenna for an mmWave band according to the present invention.

The second embodiment of the transmission line-integrated multi-port antenna having the vertical structure according to the present invention will be described below with reference to FIGS. 26 and 27. The second embodiment shown in FIG. 26 includes a plurality of antennas 2610, 2620, 2630, and 2640 and a plurality of transmission lines 2615, 2625, 2635, and 2645. The plurality of antennas 2610, 2620, 2630, and 2640 are equal to the plurality of antennas 1610, 1620, 1630, and 1640 shown in FIG. 16, and the plurality of transmission lines 2615, 2625, 2635, and 2645 are equal to the plurality of 1615, 1625, 1635, and 1645 shown in FIG. 16.

However, in the second embodiment of the multi-port antenna having the vertical structure as the low-loss and flexible transmission line-integrated multi-port antenna for an mmWave band according to the present invention, a central conductor at one end of each of the transmission lines 2615, 2625, 2635, and 2645 is integrated with an electricity feeding portion of the corresponding antenna and a central conductor 2711, 2721, 2731, or 2741 at the other end 2710, 2720, 2730, or 2740 of each of the transmission lines 2615, 2625, 2635, and 2645 is connected to a signal line of a transmission/reception module 2650 of a mobile communication terminal and vertically arranged on a different layer 2712, 2722, 2732, or 2742.

In the plurality of transmission lines 2615, 2625, 2635, and 2645, the central conductors 2711, 2721, 2731, and 2741 form one transmission line 2670 while being vertically arranged without a gap therebetween and are horizontally spaced apart from each other on different layers for each transmission at a position 2680 close to electricity feeding portions 2613, 2623, 2633, and 2643 of the antennas such that the central conductors are integrated with the corresponding electricity feeding portions 2613, 2623, 2633, and 2643 of the antennas.

Figure 28:
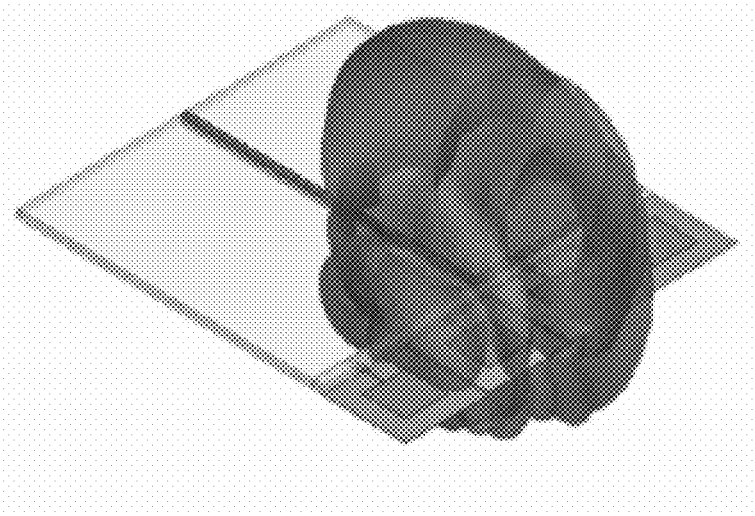
FIG. 28 illustrates a beam pattern (radiation pattern) with respect to another embodiment of the multi-port antenna having the vertical structure as the low-loss and flexible transmission line-integrated multi-port antenna for an mmWave band according to the present invention.

FIG. 28 illustrates a beam pattern (radiation pattern) with respect to the second embodiment of the multi-port antenna having the vertical structure as the low-loss and flexible transmission line-integrated multi-port antenna for an mmWave band according to the present invention. The beam pattern is electric field strength of a radiated electromagnetic wave. Referring to FIG. 28, synthetic electric field strength of the multi-port antenna is greater than electric field strength of the single-port antenna shown in FIG. 10 and may radiate an electromagnetic wave signal into the air longer distance.

Figure 29:
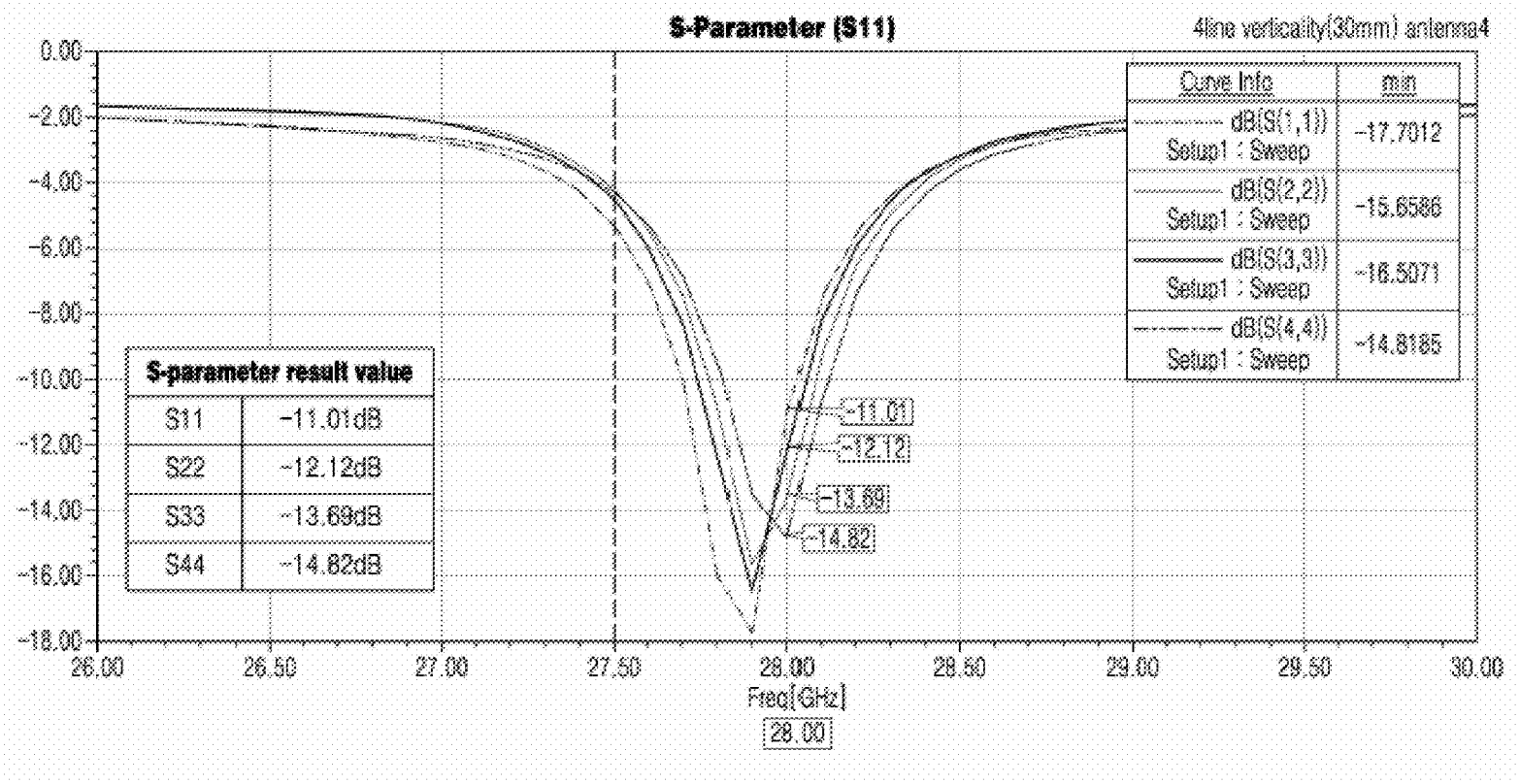
FIG. 29 illustrates a property of an input reflection parameter S11 according to a frequency with respect to another embodiment of the multi-port antenna having the vertical structure as the low-loss and flexible transmission line-integrated multi-port antenna for an mmWave band according to the present invention.

FIG. 29 illustrates a property of an input reflection parameter S according to a frequency with respect to the second embodiment of the multi-port antenna having the vertical structure as the low-loss and flexible transmission line-integrated multi-port antenna for an mmWave band according to the present invention. Referring to FIG. 29, it may be seen that the transmission line-integrated multi-port patch antenna according to one embodiment of the present invention has excellent impedance with respect to signal power input into the antenna and an excellent reflection parameter at a frequency of 28 GHz which is a 5G communication frequency.

Figure 30:
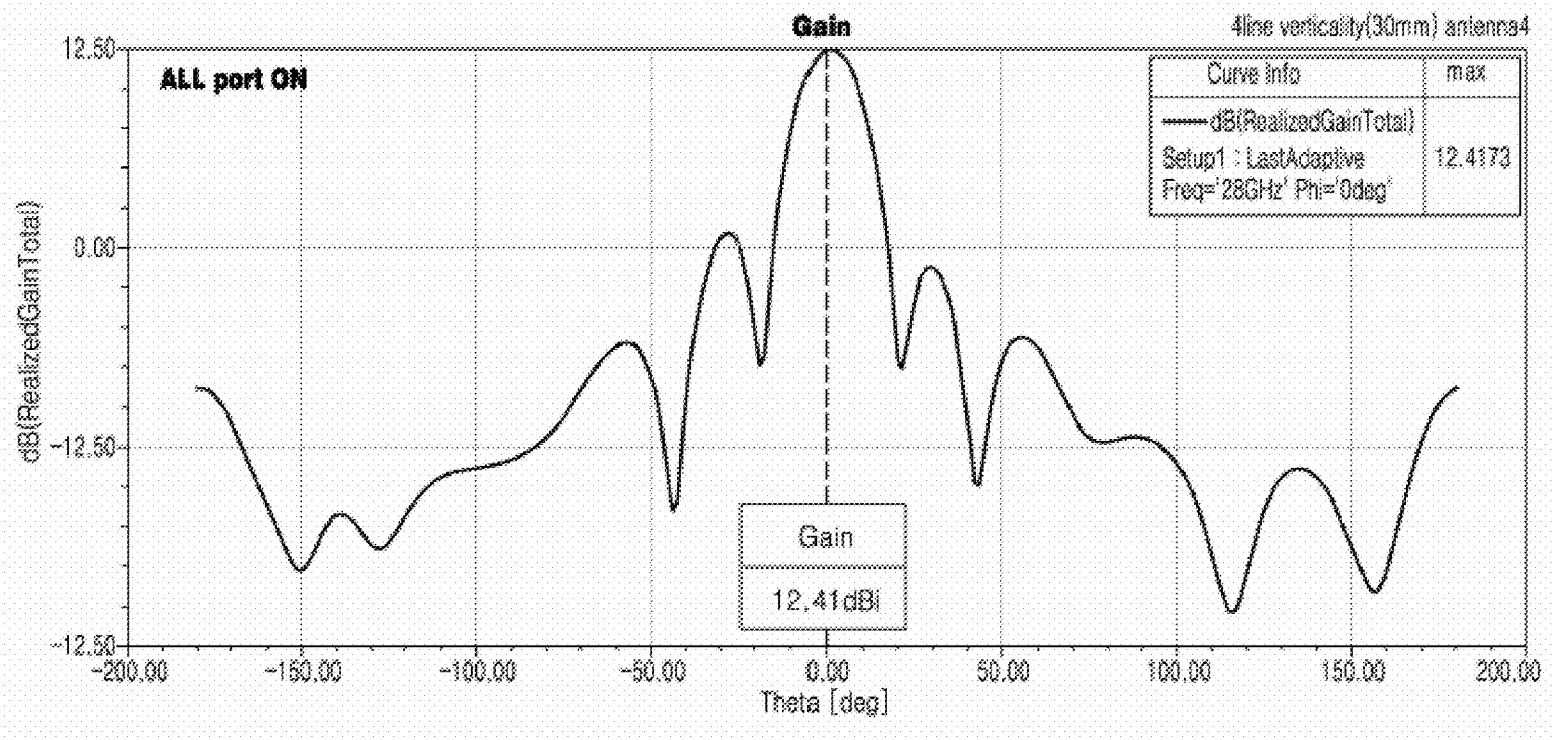
FIG. 30 illustrates a gain property with respect to another embodiment of the multi-port antenna having the vertical structure as the low-loss and flexible transmission line-integrated multi-port antenna for an mmWave band according to the present invention.

FIG. 30 illustrates a gain property with respect to the second embodiment of the multi-port antenna having the vertical structure as the low-loss and flexible transmission line-integrated multi-port antenna for an mmWave band according to the present invention. Referring to FIG. 30, it may be seen that when an input signal is applied to the multi port, a gain property of vertical polarization is about 12.41 dBi at 0 radian which is a very high antenna gain property.

Figure 31:
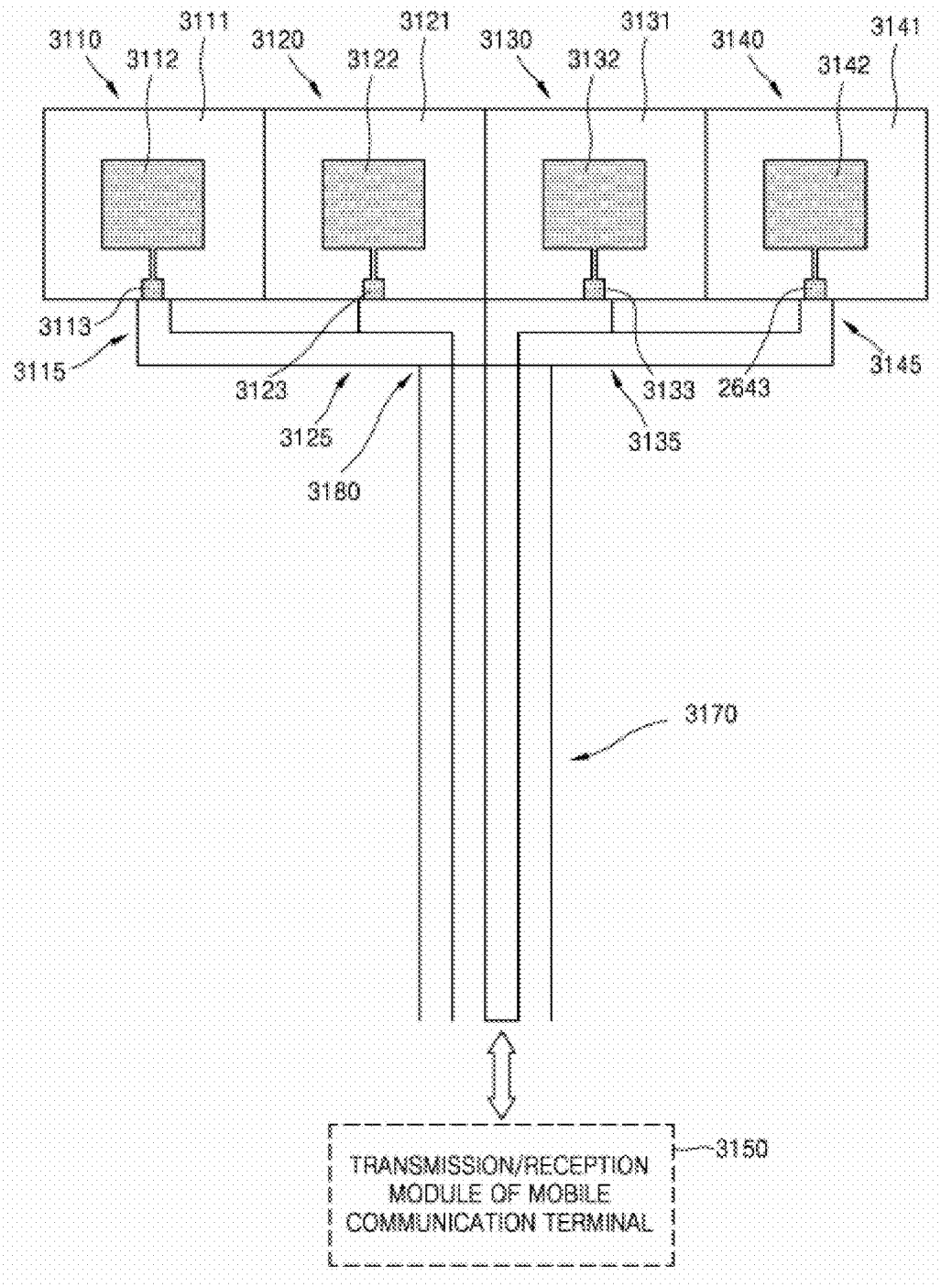
FIG. 31 is a plan view illustrating one embodiment of a multi-port antenna having a horizontal structure as the low-loss and flexible transmission line-integrated multi-port antenna for an mmWave band according to the present invention.
Figure 32:
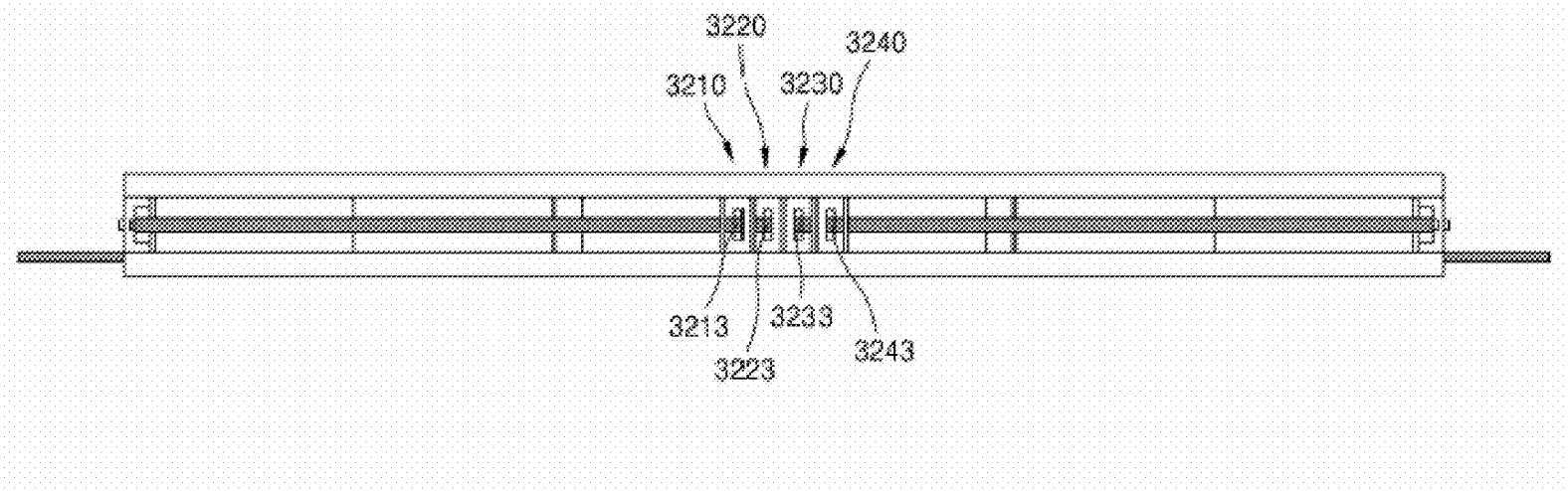
FIG. 32 is a side view illustrating one embodiment of the multi-port antenna having the horizontal structure as the low-loss and flexible transmission line-integrated multi-port antenna for an mmWave band according to the present invention.

FIG. 31 is a plan view illustrating a first embodiment of a multi-port antenna having a horizontal structure as the low-loss and flexible transmission line-integrated multi-port antenna for an mmWave band according to the present invention. FIG. 32 is a side view illustrating the first embodiment of the multi-port antenna having the horizontal structure as the low-loss and flexible transmission line-integrated multi-port antenna for an mmWave band according to the present invention.

Referring to FIGS. 31 and 32, the low-loss and flexible transmission line-integrated multi-port antenna for an mmWave band according to the present invention includes a plurality of antennas 3110, 3120, 3130, and 3140 and a plurality of transmission lines 3115, 3125, 3135, and 3145.

The plurality of antennas 3110, 3120, 3130, and 3140 are arranged on the same substrate layer and form a multi port, for example, four ports.

The plurality of transmission lines 3115, 3125, 3135, and 3145 correspond to the plurality of antennas 3110, 3120, 3130, and 3140, respectively. Central conductors 3213, 3223, 3233, and 3243 used as signal lines of the respective transmission lines are integrated with corresponding electricity feeding portions 3113, 3123, 3133, and 3143 of the antennas and are arranged on the same layer.

As described above with reference to FIGS. 1A to 18, each of the plurality of antennas 3110, 3120, 3130, and 3140 includes a dielectric substrate 3111, 3121, 3131, 3141, 420, 520, or 620, a signal conversion portion 3112, 3122, 3132, 3142, 430, 530, or 630, and the electricity feeding portion 3113, 3123, 3133, 3143, 440, 540, or 640.

The dielectric substrate 3111, 3121, 3131, 3141, 420, 520, or 620 is formed of a dielectric having a certain thickness on the ground plate 410 or 610. The signal conversion portion 3112, 3122, 3132, 3142, 430, 530, or 630 is formed on the dielectric substrate 3111, 3121, 3131, 3141, 420, 520, or 620 and converts an electrical signal of a mobile communication device into an electromagnetic wave signal and radiates the electromagnetic wave signal into the air or receives and converts an electromagnetic wave signal in the air into an electrical signal of a mobile communication terminal. The electricity feeding portion 3113, 3123, 3133, 3143, 440, 540, or 640 is formed on the dielectric substrate 3111, 3121, 3131, 3141, 420, 520, or 620 and connected to the signal conversion portion 3112, 3122, 3132, 3142, 430, 530, or 630.

Also, each of the plurality of transmission lines 3115, 3125, 3135, and 3145 includes the central conductor 3213, 3223, 3233, 3243, 710, or 810, the external conductor 720 or 820, and the dielectric 730 or 830.

One end of the central conductor 710 or 810 is integrated with the electricity feeding portion 3113, 3123, 3133, 3143, 440, 540, or 630 and transfers the transmitted or received electrical signal.

The external conductor 720 or 820 has the same axis as that of the central conductor 3213, 3223, 3233, 3243, 710, or 810 and shields the central conductor 3213, 3223, 3233, 3243, 710, or 810 in an axial direction of the central conductor 3213, 3223, 3233, 3243, 710, or 810.

The dielectric 730 or 830 is formed between the central conductor 3213, 3223, 3233, 3243, 710, or 810 and the external conductor 720 or 820 in the axial direction.

The dielectric 730 or 830 may be a nanostructured sheet material formed by electrospinning a resin at a high voltage as described above with reference to FIG. 9.

In the first embodiment of the multi-port antenna having the horizontal structure as the low-loss and flexible transmission line-integrated multi-port antenna for an mmWave band according to the present invention, the central conductors 3213, 3223, 3233, and 3243 of the other ends 3210, 3220, 3230, and 3240 of the transmission lines 3115, 3125, 3135, and 3145 are connected to signal lines of a transmission/reception module 3150 of a mobile communication terminal and horizontally arranged on the same layer.

In the plurality of transmission lines 3115, 3125, 3135, and 3145, the central conductors 3213, 3223, 3233, and 3243 form one transmission line 3170 while being horizontally arranged without a gap therebetween and are horizontally spaced apart from each other on the same layer for each transmission at a position 3180 close to electricity feeding portions 3113, 3123, 3133, and 3143 of the antennas such that the central conductors are integrated with the corresponding electricity feeding portions 3113, 3123, 3133, and 3143 of the antennas.

Figure 33:
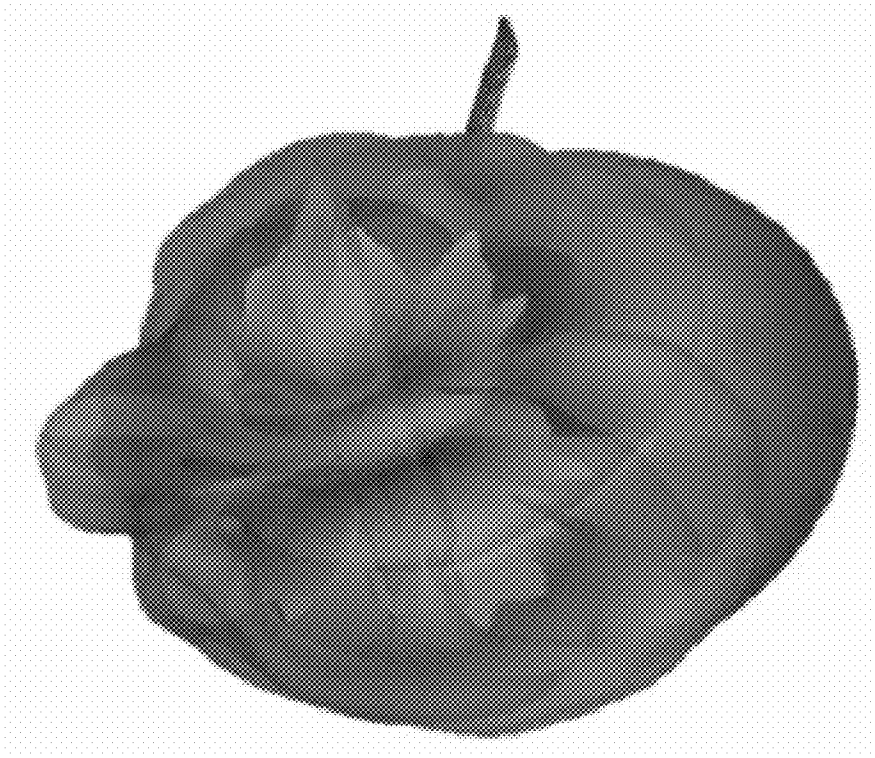
FIG. 33 illustrates a beam pattern (radiation pattern) with respect to one embodiment of the multi-port antenna having the horizontal structure as the low-loss and flexible transmission line-integrated multi-port antenna for an mmWave band according to the present invention.

FIG. 33 illustrates a beam pattern (radiation pattern) with respect to the first embodiment of the multi-port antenna having the horizontal structure as the low-loss and flexible transmission line-integrated multi-port antenna for an mmWave band according to the present invention. The beam pattern is electric field strength of a radiated electromagnetic wave. Referring to FIG. 33, synthetic electric field strength of the multi-port antenna is greater than electric field strength of the single-port antenna shown in FIG. 10 and may radiate an electromagnetic wave signal into the air longer distance.

Figure 34:
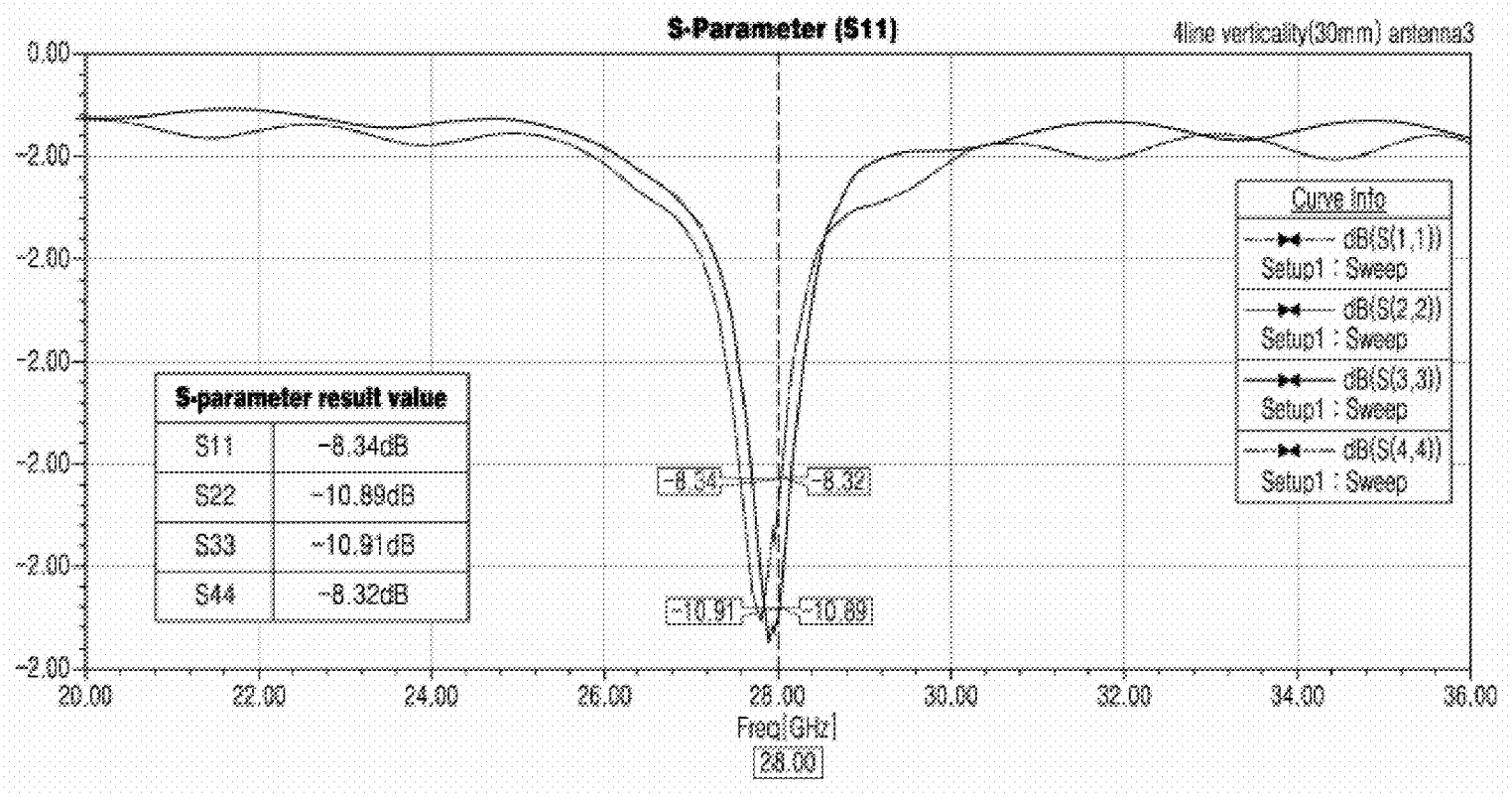
FIG. 34 illustrates a property of an input reflection parameter S11 according to a frequency with respect to one embodiment of the multi-port antenna having the horizontal structure as the low-loss and flexible transmission line-integrated multi-port antenna for an mmWave band according to the present invention.

FIG. 34 illustrates a property of an input reflection parameter S11 according to a frequency with respect to the first embodiment of the multi-port antenna having the horizontal structure as the low-loss and flexible transmission line-integrated multi-port antenna for an mmWave band according to the present invention. Referring to FIG. 34, it may be seen that the transmission line-integrated multi-port patch antenna according to one embodiment of the present invention has excellent impedance with respect to signal power input into the antenna and an excellent reflection parameter at a frequency of 28 GHz which is a 5G communication frequency.

Figure 35:
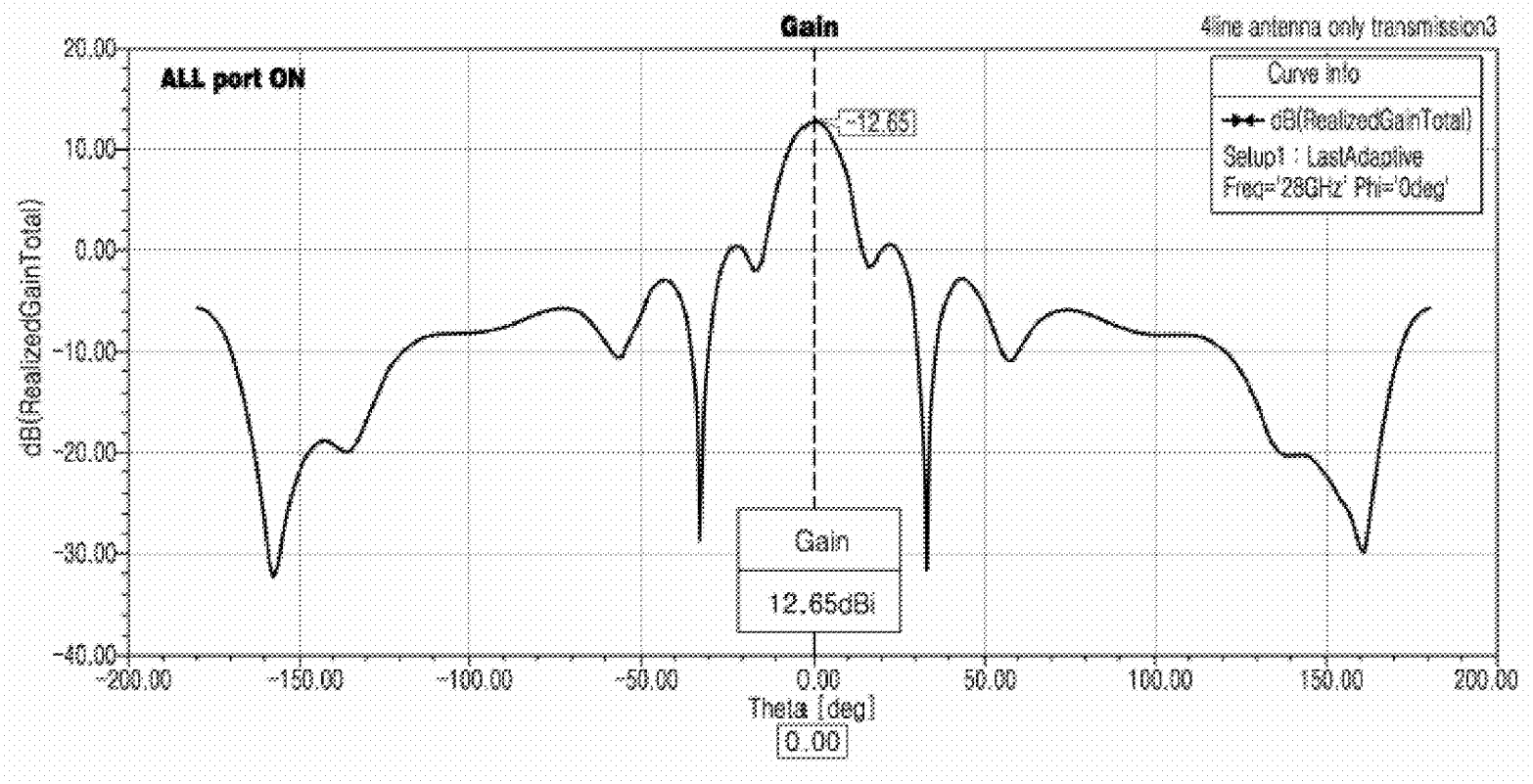
FIG. 35 illustrates a gain property with respect to one embodiment of the multi-port antenna having the horizontal structure as the low-loss and flexible transmission line-integrated multi-port antenna for an mmWave band according to the present invention.

FIG. 35 illustrates a gain property with respect to one example of the multi-port antenna having the horizontal structure as the low-loss and flexible transmission line-integrated multi-port antenna for an mmWave band according to the present invention. Referring to FIG. 35, it may be seen that when an input signal is applied to the multi port, a gain property of vertical polarization is about 12.65 dBi at 0 radian which is a very high antenna gain property. Meanwhile, a second embodiment of the multi-port antenna having the horizontal structure as the low-loss and flexible transmission line-integrated multi-port antenna for an mmWave band according to the present invention includes a plurality of antennas and a plurality of transmission lines. The plurality of antennas are horizontally arranged on the same substrate layer and form a multi port.

The plurality of transmission lines correspond to the plurality of antennas. Central conductors used as signal lines of the transmission lines are integrated with corresponding electricity feeding portions of the antennas and horizontally arranged on the same layer.

Each of the antennas and each of the transmission lines are equal to those of the first embodiment of the multi-port antenna having the horizontal structure as the low-loss and flexible transmission line-integrated multi-port antenna for an mmWave band.

That is, each of the antennas includes a dielectric substrate, a signal conversion portion, and an electricity feeding portion. The dielectric substrate is formed as a dielectric having a certain thickness on the ground plate. The signal conversion portion is formed on the dielectric substrate. The signal conversion portion converts an electrical signal of a mobile communication terminal into an electromagnetic wave signal and radiates the electromagnetic wave signal into the air or receives an electromagnetic wave signal in the air and converts the electromagnetic wave signal into an electric signal of a mobile communication terminal. The electricity feeding portion is formed on the dielectric substrate and is connected to the signal conversion portion.

The transmission line includes a central conductor, an external conductor, and a dielectric. One end of the central conductor is integrated with the electricity feeding portion of the antenna and transfers the transmitted or received electrical signal. The external conductor has the same axis as that of the central axis and shields the central conductor in an axial direction of the central conductor. The dielectric is formed between the central conductor and the external conductor in the axial direction.

The dielectric may be a nanostructured sheet material formed by electrospinning a resin at a high voltage.

Also, in the second embodiment of the multi-port antenna having the horizontal structure as the low-loss and flexible transmission line-integrated multi-port antenna for an mmWave band, like in the first embodiment, the central conductor at one end of each transmission line is integrated with the electricity feeding portion of the corresponding antenna, the central conductor at the other end of each transmission line is connected to a signal line of a transmission/reception module of a mobile communication terminal, and the central conductors at the other ends of the transmission lines are horizontally arranged on the same layer.

However, the second embodiment differs from the first embodiment in which the transmission lines are horizontally spaced apart from each other at a position close to the transmission/reception module and are close and integrally connected to the corresponding electricity feeding portions of the antennas while being spaced apart from each other.

Meanwhile, the low-loss and flexible transmission line-integrated multi-port antenna for an mmWave band according to the embodiments of the present invention may be used while being mounted in a 5G mobile communication device.

Figure 36A:
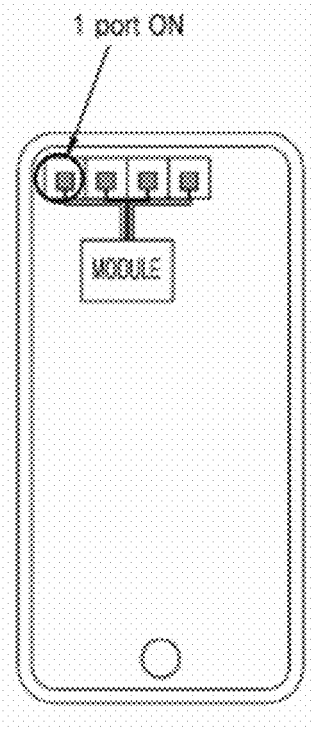
FIG. 36A illustrates an example of a mobile communication device in which the low-loss and flexible transmission line-integrated multi-port antenna for an mmWave band according to the embodiments of the present invention is mounted.
Figure 36B:
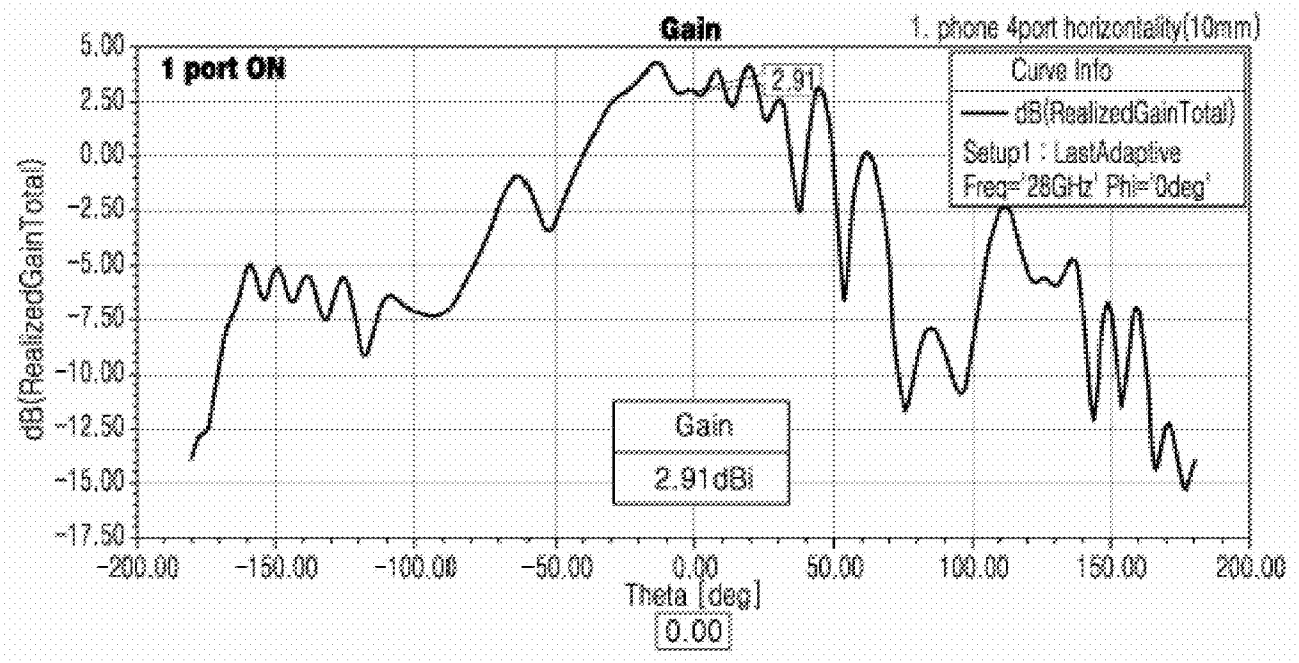
Figure 37A:
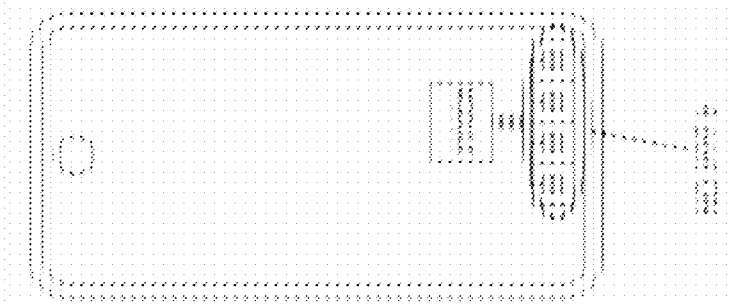
FIG. 37A illustrates an example of the mobile communication device in which the low-loss and flexible transmission line-integrated multi-port antenna for an mmWave band according to the embodiments of the present invention is mounted.
Figure 37B:
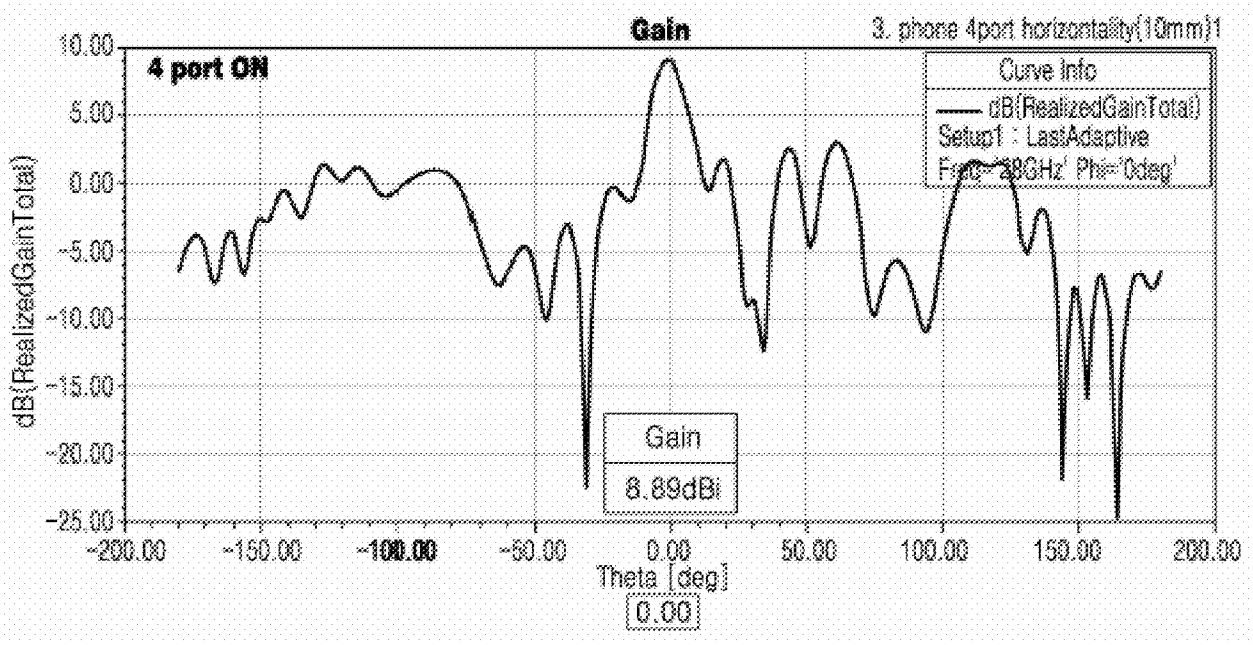
Figure 38A:
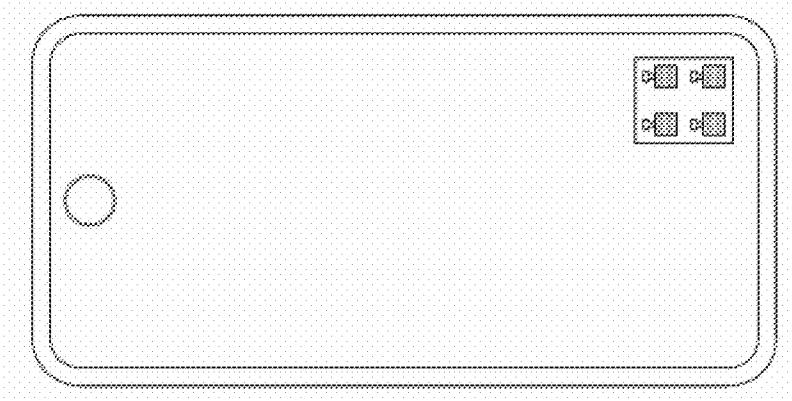
FIG. 38A illustrates another example of a mobile communication device in which a low-loss and flexible transmission line-integrated multi-port antenna having four ports according to an embodiment of the present invention is mounted.
Figure 38B:
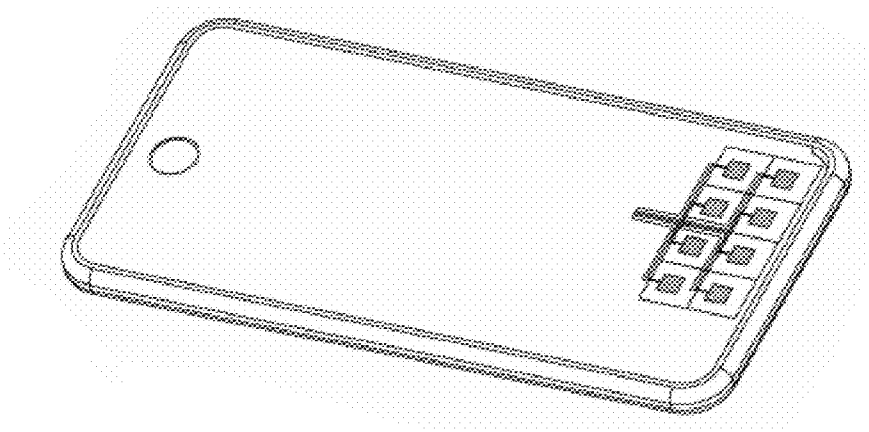
FIG. 38B illustrates an example of a mobile communication terminal in which an antenna including eight ports is mounted.

FIG. 36A illustrates an example of a mobile communication device in which the low-loss and flexible transmission line-integrated multi-port antenna for an mmWave band according to the embodiments of the present invention is mounted. FIG. 36B illustrates a gain property when only one port is turned on. FIG. 37A illustrates an example of the mobile communication device in which the low-loss and flexible transmission line-integrated multi-port antenna for an mmWave band according to the embodiments of the present invention is mounted. FIG. 37B illustrates a gain property when all four ports are turned on. FIG. 38A illustrates another example of a mobile communication device in which a low-loss and flexible transmission line-integrated multi-port antenna having four ports according to an embodiment of the present invention is mounted. FIG. 38B illustrates an example of a mobile communication terminal in which an antenna including eight ports is mounted.

Figure 39A:
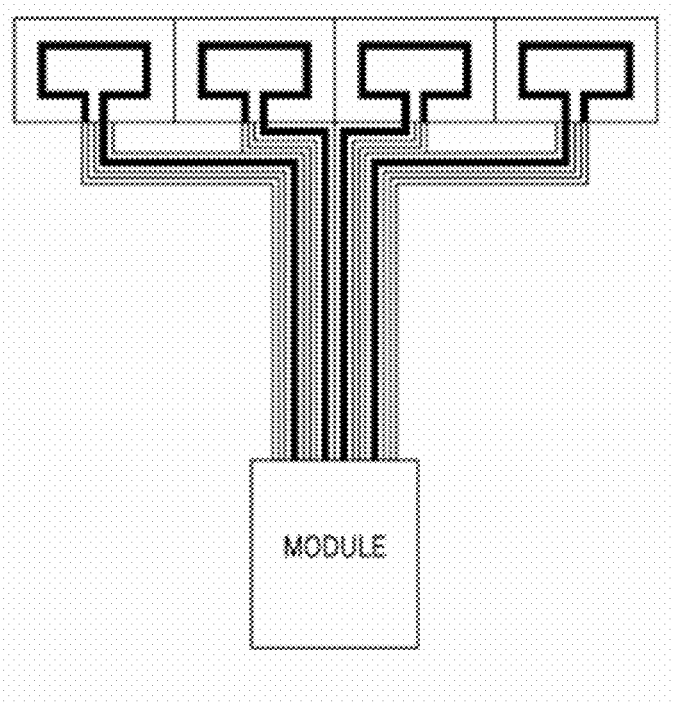
FIG. 39A illustrates a low-loss and flexible transmission line-integrated multi-port dipole antenna having four ports according to an embodiment of the present invention.
Figure 39B:
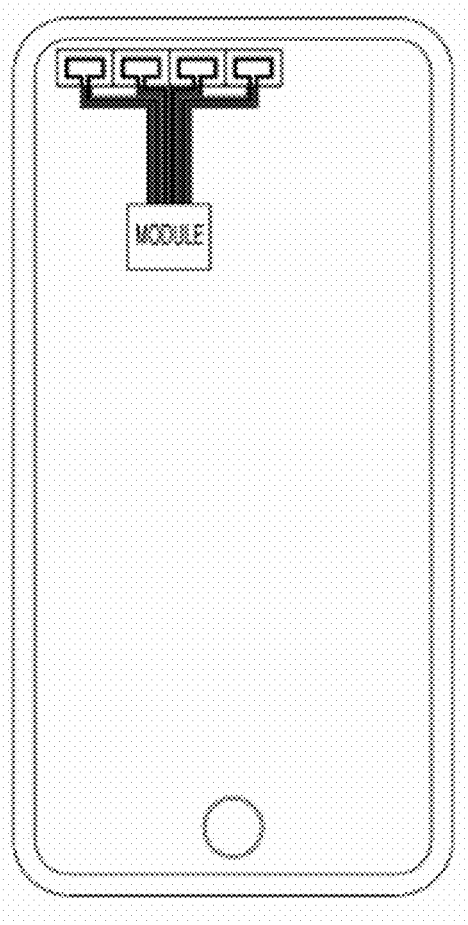
FIG. 39B illustrates an example of a mobile communication terminal in which a dipole antenna including four ports is mounted.

FIG. 39A illustrates a low-loss and flexible transmission line-integrated multi-port dipole antenna having four ports according to an embodiment of the present invention. FIG. 39B illustrates an example of a mobile communication terminal in which a dipole antenna including four ports is mounted.

According to the embodiments of the present invention, a low-loss and flexible transmission line-integrated multi-port antenna for an mmWave band may be used as an antenna for a high frequency band of several ten GHzs used in a smart phone of a next-generation 5G mobile communication system.

Particularly, the low-loss and flexible transmission line-integrated multi-port antenna according to the embodiments of the present invention uses a dielectric material having low relative dielectric permittivity and a low dielectric loss tangent value for dielectrics used in a transmission line and an antenna so as to transmit or radiate superhigh frequency signals at a less loss.

Also, in the low-loss and flexible transmission line-integrated multi-port antenna according to the embodiments of the present invention, a loss which may occur due to a connection portion between the transmission line and the antenna may be eliminated by integrating the transmission line with the antenna so as to reduce a loss of a signal in a superhigh frequency band.

Also, a mobile built-in antenna may be implemented using a flexible material having flexibility so as to locate the antenna at a position of minimizing an influence of surroundings in a mobile device such as a smart phone and the like.

Although the embodiments of the present invention have been described with reference to the drawings, the embodiments are merely examples and it should be understood by one of ordinary skill in the art that a variety of modifications and equivalents thereof may be made therefrom. Accordingly, the technical scope of the present invention should be determined by the technical concept of the following claims.

What is claimed is:

1. A low-loss and flexible transmission line-integrated multi-port antenna for an mmWave band, comprising:

a plurality of antennas arranged on different substrate layers to form a multi port; and a plurality of transmission lines corresponding to the plurality of antennas, respectively, in which central conductors used as signal lines of the transmission lines are integrated with corresponding electricity feeding portions of the antennas and arranged on different layers, wherein the antennas each comprise:

a dielectric substrate formed as a dielectric having a certain thickness on a ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having the same axis as that of the central conductor and configured to shield the central conductor in an axial direction of the central conductor; and a dielectric formed between the central conductor and the external conductor in the axial direction, and wherein the dielectric is a low-loss nanosheet material formed as a nanosheet including a lot of air spaces by electrospinning a resin at a high voltage.

2. The low-loss and flexible transmission line-integrated multi-port antenna of claim 1, wherein in the plurality of transmission lines, the central conductor at one end of each of the transmission lines is integrated with the corresponding electricity feeding portion of the antenna and the central conductor at the other end of each of the transmission lines is connected to a signal line of a transmission/reception module of the mobile communication terminal, wherein the central conductors at the other ends of the transmission lines are vertically arranged on different layers, and wherein the central conductors are horizontally spaced apart from each other on different layers at a position close to the transmission/reception module and are close and integrally connected to the corresponding electricity feeding portions of the antennas while being spaced apart from each other.

3. The low-loss and flexible transmission line-integrated multi-port antenna of claim 1, wherein in the plurality of transmission lines, the central conductor at one end of each of the transmission lines is integrated with the corresponding electricity feeding portion of the antenna and the central conductor at the other end of each of the transmission lines is connected to a signal line of a transmission/reception module of the mobile communication terminal, wherein the central conductors at the other ends of the transmission lines are vertically arranged on different layers, and wherein the plurality of transmission lines are horizontally spaced apart from each other on different layers for each transmission line at a position close to the transmission/reception module while the central conductors are vertically arranged such that the central conductors are integrated with the corresponding electricity feeding portions of the antennas.

4. The low-loss and flexible transmission line-integrated multi-port antenna according to claim 1, wherein the conductors are formed by at least one of etching, printing, and deposition.

5. The low-loss and flexible transmission line-integrated multi-port antenna according to claim 1, wherein the antennas and the transmission lines are formed by reinforcing a bonding force between the conductor and a dielectric sheet using a low-loss bonding sheet or bonding solution or depositing the conductor on a nanosheet.

6. The low-loss and flexible transmission line-integrated multi-port antenna according to claim 1, wherein the transmission lines each comprise:

a nanosheet dielectric having a certain thickness;

conductor surfaces formed on a top surface and a bottom surface of the nanosheet dielectric; and a stripline transmission line formed as a signal line in a center of the nanosheet dielectric and the conductor surfaces, and wherein a plurality of via holes are formed between the conductor surface formed above the nanosheet dielectric and the conductor surface formed below the nanosheet dielectric.

7. The low-loss and flexible transmission line-integrated multi-port antenna according to claim 1, wherein the antennas each have a structure of a patch antenna, a microstrip patch antenna, or a diagonal line type patch antenna, in which the signal conversion portion is a patch, wherein the patch antenna or the microstrip antenna is formed of a metal and further comprises a ground plate located on a bottom surface, and wherein the dielectric substrate is formed as a dielectric having a certain thickness on the ground plate and has a transmission line-extended type structure.

8. The low-loss and flexible transmission line-integrated multi-port antenna according to claim 1, wherein the antenna is a dipole antenna, a monopole antenna, or a slot antenna implemented using a variety of slots.

9. The low-loss and flexible transmission line-integrated multi-port antenna according to claim 1, wherein the antenna is a planar inverted F antenna (PIFA) as a built-in antenna built in a mobile communication terminal.

10. A mobile communication terminal comprising the low-loss and flexible transmission line-integrated multi-port antenna according to claim 1.

* * * * *